US008763616B2

(12) United States Patent
Koptis et al.

(10) Patent No.: US 8,763,616 B2
(45) Date of Patent: Jul. 1, 2014

(54) MULTI-SURFACE CLEANING APPARATUS AND METHOD

(76) Inventors: Kurt Koptis, Auburn, CA (US); David McGovern, Roseville, CA (US); Bruce Bodlak, Folsom, CA (US)

( * ) Notice: Subject to any disclaimer, the term of this patent is extended or adjusted under 35 U.S.C. 154(b) by 530 days.

(21) Appl. No.: 13/124,854

(22) PCT Filed: Oct. 21, 2009

(86) PCT No.: PCT/US2009/061449

§ 371 (c)(1),
(2), (4) Date: Apr. 19, 2011

(87) PCT Pub. No.: WO2010/048265

PCT Pub. Date: Apr. 29, 2010

(65) Prior Publication Data

US 2011/0197917 A1 Aug. 18, 2011

Related U.S. Application Data

(60) Provisional application No. 61/196,976, filed on Oct. 21, 2008.

(51) Int. Cl.
*B08B 3/00* (2006.01)

(52) U.S. Cl.
USPC ..... 134/93; 134/184; 15/104.001; 15/143.1; 401/263; 401/270

(58) Field of Classification Search
CPC ..... A46B 11/001; A46B 2200/3026; A46B 2200/3033; A46B 2200/3093; A47L 13/17; B65D 73/0071
See application file for complete search history.

(56) References Cited

U.S. PATENT DOCUMENTS

| | | | | |
|---|---|---|---|---|
| 4,013,369 | A * | 3/1977 | Turek | 401/139 |
| 4,955,747 | A * | 9/1990 | Tarver | 401/139 |
| 6,213,129 | B1 * | 4/2001 | Muldoon | 132/120 |
| 7,309,182 | B2 | 12/2007 | McKay | |
| 2007/0212157 | A1 * | 9/2007 | Hoadley et al. | 401/136 |

* cited by examiner

*Primary Examiner* — Eric Golightly
(74) *Attorney, Agent, or Firm* — Law Offices of David M. Lang; David M. Lang

(57) ABSTRACT

A multisurface cleaning tool having a tapering head and a hollow handle contiguous with the head that constitutes a reservoir capable of holding flowable material. A pump actuated dispenser is in communication with the reservoir and permits user actuated expression of flowable material from within the reservoir. A cover is applied to and covers at least a portion of the head. In one embodiment, the cover is a microfiber pouch with an elasticized perimeter, which permits the pouch to be fitted over the cleaning tool head. In another embodiment, a portion of the cover is an integrally formed abrasive surface.

3 Claims, 21 Drawing Sheets

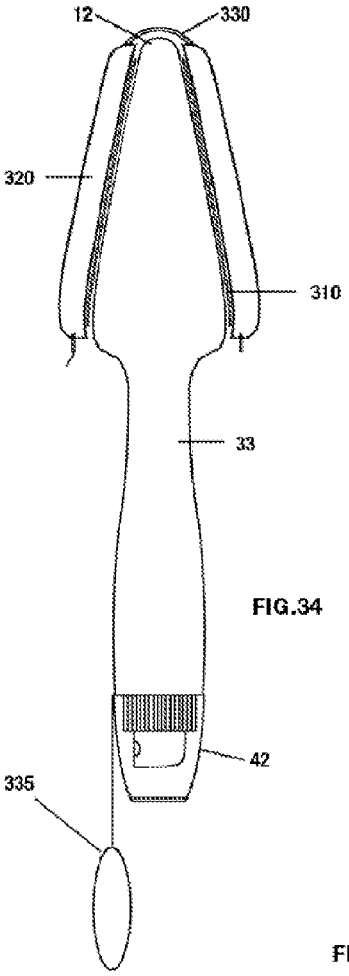
FIG.34
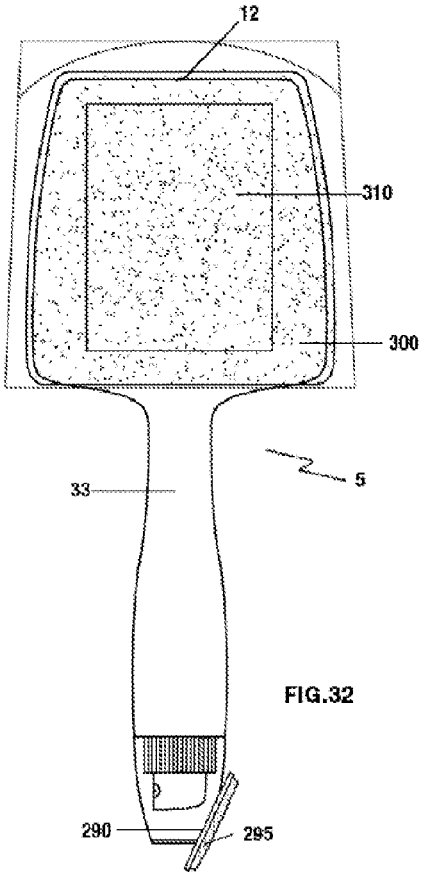
FIG.32
FIG.33
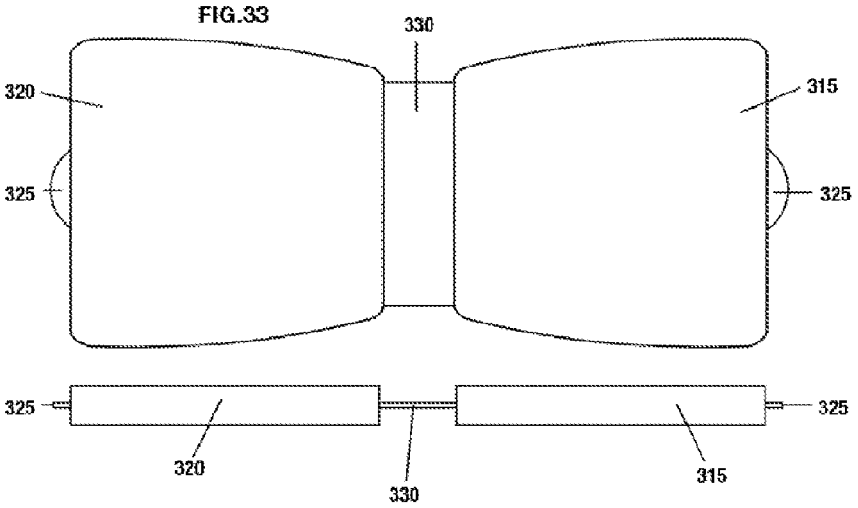

MULTI-SURFACE CLEANING APPARATUS AND METHOD

CROSS-REFERENCE TO RELATED APPLICATIONS

This application claims the benefit under 35 U.S.C. 119(e) to U.S. Provisional Application 61/196,976, entitled "INTEGRATED GLASS AND MULTI SURFACE CLEANER, POLISHER AND METHOD OF USE" filed Oct. 21, 2008, and PCT/US09/61449 filed on Oct. 21, 2009, both of which are herein incorporated by reference in their entirety and made part of this specification.

FIELD OF THE INVENTION

The present invention relates to hand-held cleaning apparatus generally, and more specifically, to an integrated cleaning hand tool apparatus adapted to hold and distribute liquid and a variety of cleaning, polishing, and drying surfaces attached thereto, and methods directed toward efficient distribution of liquid product on a surface and cleaning, polishing, and drying a surface.

BACKGROUND

Cleaning apparatus and vessels of various types are known in the prior art. The most presently familiar is the reservoir bottle attached to a finger-actuated sprayer. U.S. Pat. No. 7,309,182 to McKay, discloses, in part, a substrate with outward projecting bristles, where the substrate may be mounted on a support which may carry a handle or on a media dispensing container. The handle is hollow to carry a dispensable media from a dispenser mounted on the handle, or has an open end to receive an aerosol or media dispensing container. Several embodiments disclosed by McKay teach, in part, a cylindrical brush-type apparatus having a mat or substrate that may be disposed around a support and secured. Other embodiments disclose, in part, a wipe in the form of a sheet or scrim that may be mounted over bristles. McKay is not adapted for the use of microfiber cleaning, polishing, and drying; and embodiments of McKay, thought having an embodiment featuring a tapered cross section, tend to promote surface scratching where a hinge is used to connect adjoining mat sections. Additionally, the apex McKay's tapered embodiment is aggressively pointed which offers minimal cleaning and polishing surface contact, and would lead to delicate microfiber fabric weakening and eventual tearing. Further, McKay's mat adds to manufacturing cost and complexity, and may result in instability of the cleaning/brushing surface in embodiments where, during use, bristles encounter resistance and displace the mat relative to the cleaning support.

What is needed is a cleaning and polishing inventive apparatus that more fully provides bristle stability when cleaning What is further needed is an apparatus which can accommodate a variety of microfiber coverings to provide a wide range of cleaning functions. Moreover, what is further needed is an apparatus which can be adapted to a variety of cleaning, polishing, and drying surfaces located on the same cleaning tool and provide embodiments which maintain hands free from the cleaning surface when apparatus is in use.

SUMMARY

The present inventive cleaning apparatus hand tool that permits more ergonomic use, is versatile, compact, and cost effective to manufacture and produce. Embodiments of the present invention provide a covering which may be affixed to an apparatus head, while other embodiments feature a removable covering, or a combination of removable and fixed covering. A portion of the apparatus is hollow and may be used as a product dispenser to retain and dispense various flowable solutions. Embodiments of the present invention feature a scrubbing surface to aid in removing debris. Other embodiments of the present invention teach a cleaning head of varying size and shape to permit navigation of small or select areas. Embodiments of the present invention teach a various cleaning, drying, and polishing surfaces such as brushes, sponges, microfiber, abrasive surfaces, melamine, and tacky surfaces. In some embodiments the coverings are removable, in others they are affixed.

BRIEF DESCRIPTION OF THE DRAWINGS

FIG. 32 is a front elevation view of a VELCRO attachment and embodiment flip top scrubber pad dispenser cover.

FIG. 33 is a top and side elevation view of an embodiment of the present invention illustrating an embodiment cover.

FIG. 34 is a side elevation view of an embodiment of the present invention illustrating VELCRO attachment of cover and holding strap.

DETAILED DESCRIPTION

Figure 1:
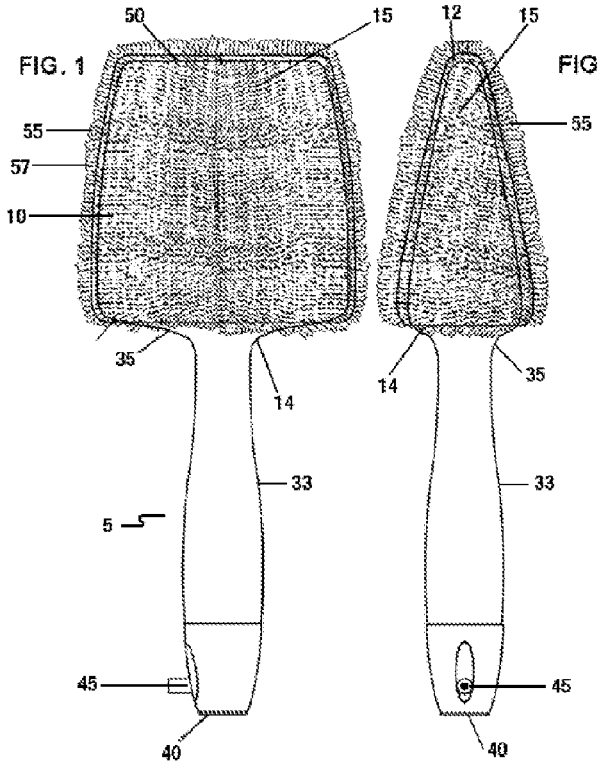
FIG. 1 is a front and side elevation view of one embodiment of the present apparatus having a noodle microfiber cover.

Turning now to the illustrations, FIG. 1 illustrates an embodiment integrated apparatus 5 as adapted for washing and waxing a vehicle. The apparatus head 10, having an apex 12, a base, 14, a first surface 15 and second 20 surface, and a first 25 and second side 30 surface, is relatively wide relative to handle 33 and attaches where handle 15 narrows to form neck 35. In a preferred embodiment, handle 15 has an internal void that serves as a reservoir for flowable cleaning, polishing and/or protecting materials such as cleaner, polisher, wax, and the like. A dispensing means such as a finger actuated pump 40 having a dispensing port 45 may be located on the end of handle 15 and fastened thereupon. In one embodiment, actuated pump 40 is integrally formed with handle and not removable. In one embodiment, pump 40 is reversibly affixed to the end of handle 15; pump 40 may be affixed by any known means including threadable engagement, friction fit, or notches or grooves engaging detents. Lotion and spray pumps, are well known and commonly used in the art; selection of a suitable type will be dependent on the viscosity of the flowable substance and other factors such as the anticipated required volume and desired dispersion pattern of a given product. Head 10 may be covered with a cover 50. In one embodiment, cover 50 comprises a microfiber pouch with an elasticized perimeter capable of securing the cover snugly around head 10 approximately in the location of neck 35. In one embodiment illustrated by FIG. 1, microfiber cover 50 is comprised of a noodle microfiber 57.

Figure 2:
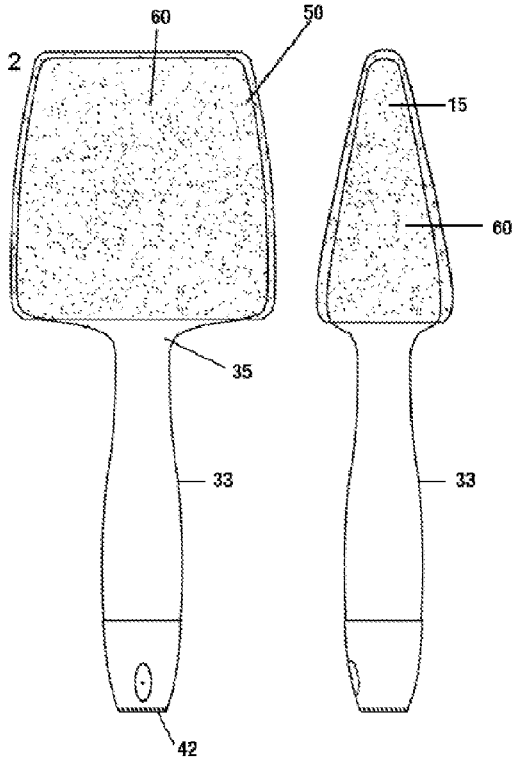
FIG. 2 is a front and side elevation view of one embodiment of the present apparatus having a microfiber cover.
Figure 3:
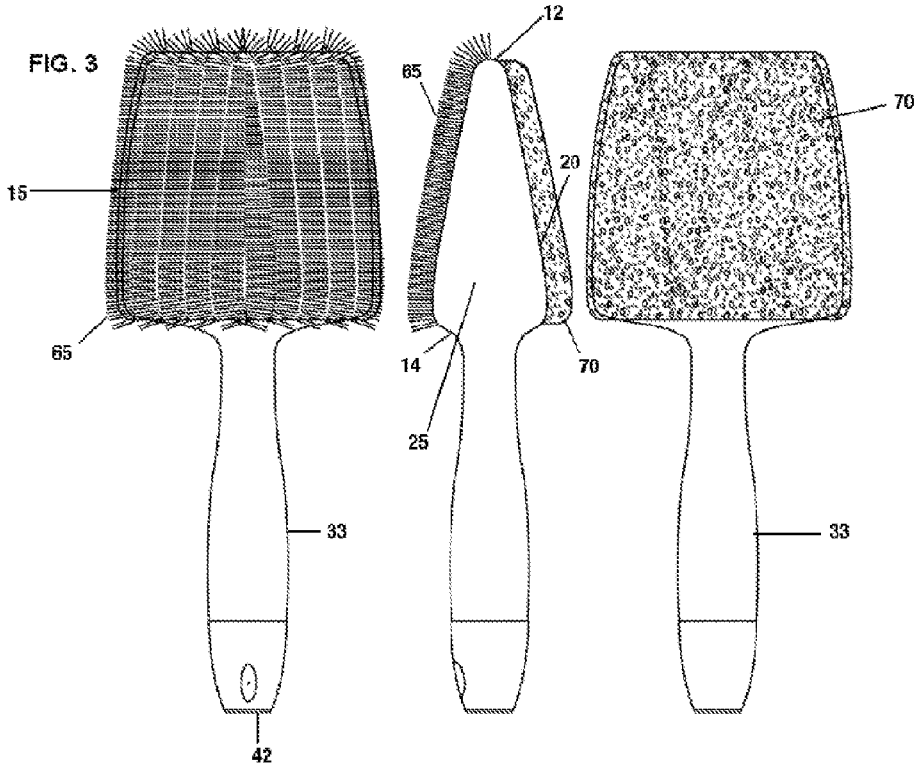
FIG. 3 is a front, side, and rear elevation view of one embodiment of the present apparatus having a brush on one surface and semi-soft abrasive sponge on the other surface.

Turning now to FIG. 2, head 10 may be covered with a microfiber cover 50 that is adapted for glass cleaning, and may be reversible and machine washable. The dispensing means may be a finger actuated sprayer 42 drawing relatively low viscosity flowable material from the internal void reservoir of handle 33. In this embodiment, said cover 60 is comprised of a microfiber pouch with an elasticized perimeter. This embodiment may be useful as a wax detailer FIG. 3 illustrates first surface 15 having bristles 65 which may be formed on a plate and adhesively attached to first surface 15 or integrally formed by extruding molten thermoplastic material as filaments. A semi-soft abrasive sponge 70 covers second surface 20, and may be affixed by adhesive or ultrasonic welding. There are a variety of methods known in the prior art for affixing bristles to a surface and adherently affixing an element to a thermoplastic member: the present invention may be practiced by utilizing any suitable method of affixation. This embodiment may be well adapted for carpet cleaning, as well as removing material from wet surfaces such as algae and debris from shower tile, pool tile, and aquarium surfaces.

Figure 4:
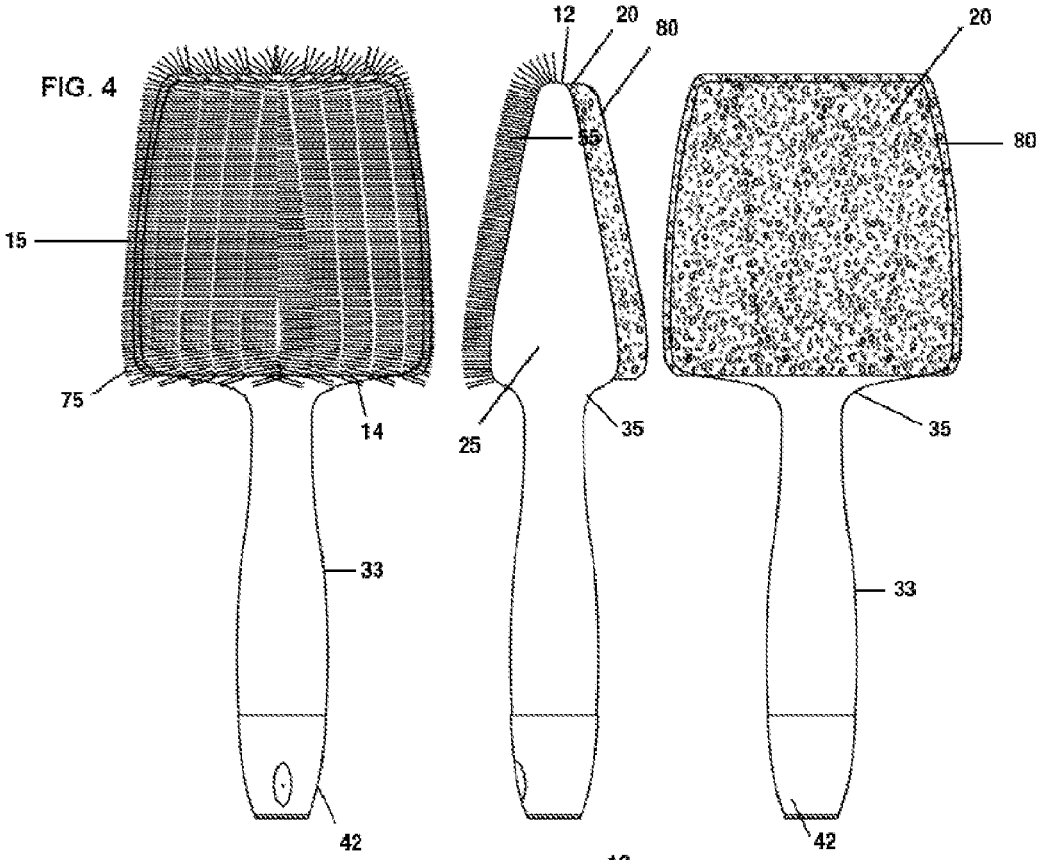
FIG. 4 is a front, side, and rear view of the present apparatus having a concentrated brush on one surface and a soft sponge on another surface of the apparatus head.

FIG. 4 illustrates first surface 15 having a concentrated brush 75, and second surface 20 having a soft sponge 80, outdoor furniture cleaning, with high bristle density.

Figure 5:
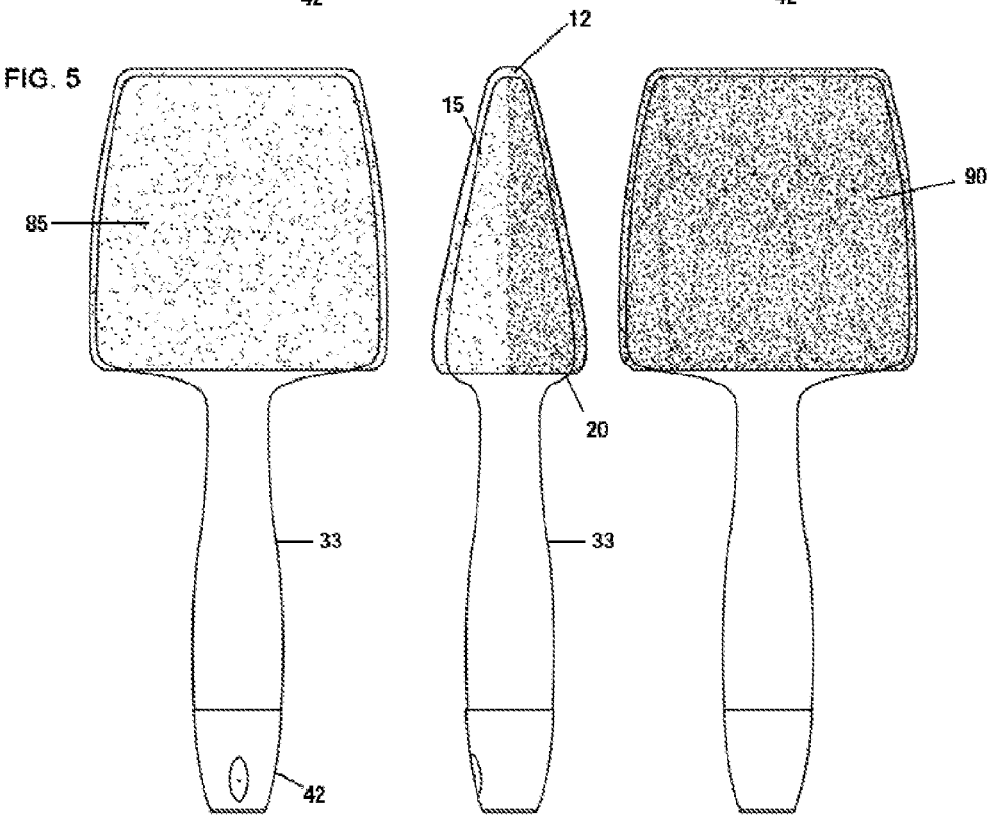
FIG. 5 is a front, side, and rear elevation view of one embodiment of the present apparatus having a microfiber cover, and a second microfiber cover or terry cloth microfiber towel on the apparatus head.

In an embodiment illustrated by FIG. 5 first surface 15 has a microfiber cloth 85, and a terry cloth microfiber towel (not shown) material affixed to second surface 20. First 25 and second 30 side surfaces are approximately half-covered in the cloth 85. This embodiment, having differing active microfiber surfaces on the first 25 and second 30 sides is able to negotiate relatively small spaces, contains no hard surfaces, and thus may be particularly useful for automobile detailing and wax application specifically. This embodiment may also be useful for wood cleaning, polishing, and wood rejuvenation. Head 10 having dual-microfiber surfaces becomes a more flexible and efficient cleaning and polishing instrument.

Figure 6:
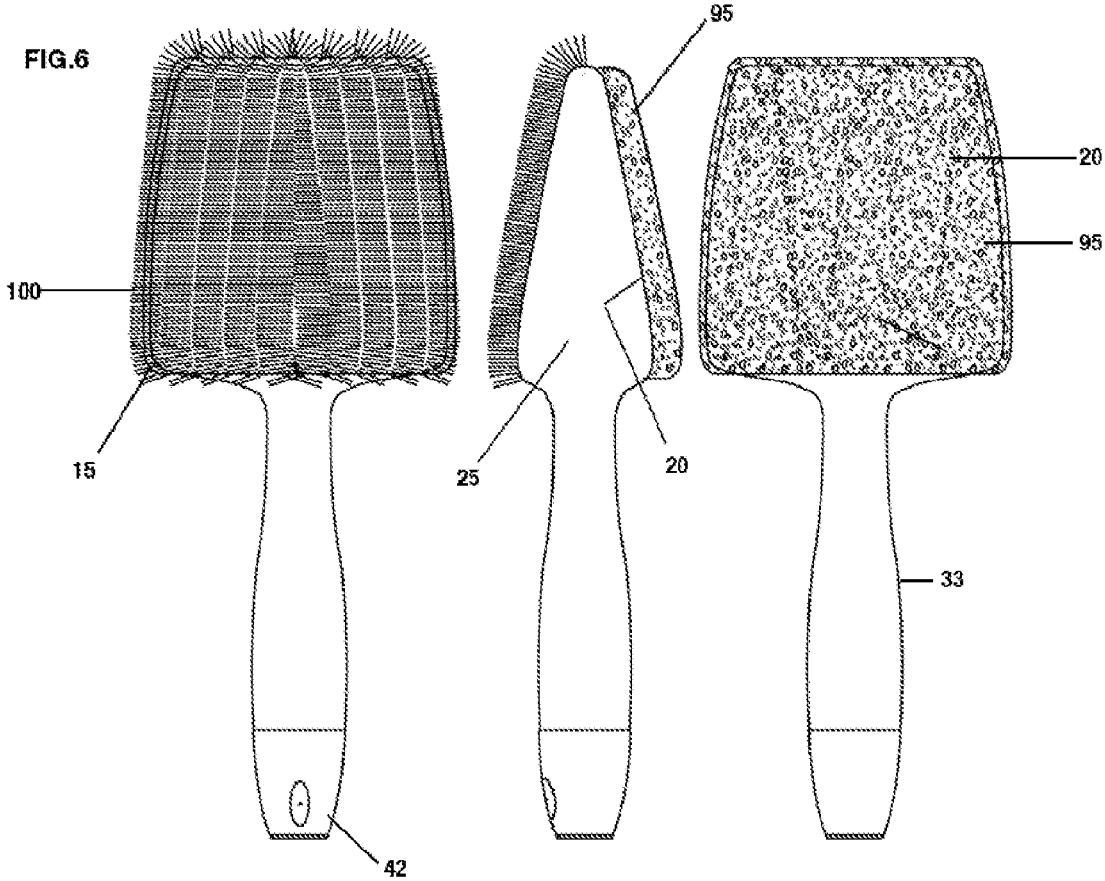
FIG. 6 is a front, side and rear elevation view of one embodiment of the present apparatus with a brush covering one side and a thick chamois-type surface or simple sponge covering another surface of apparatus head.

FIG. 6 illustrates first surface 15, with brush 100 covers first surface 15 and thick chamois-type surface 95 or simple sponge (not shown) covers second surface 20. This adaptation couples absorption with scrubbing ability and is particularly useful for removal of carpet spills, stains, and spots.

Figure 7:
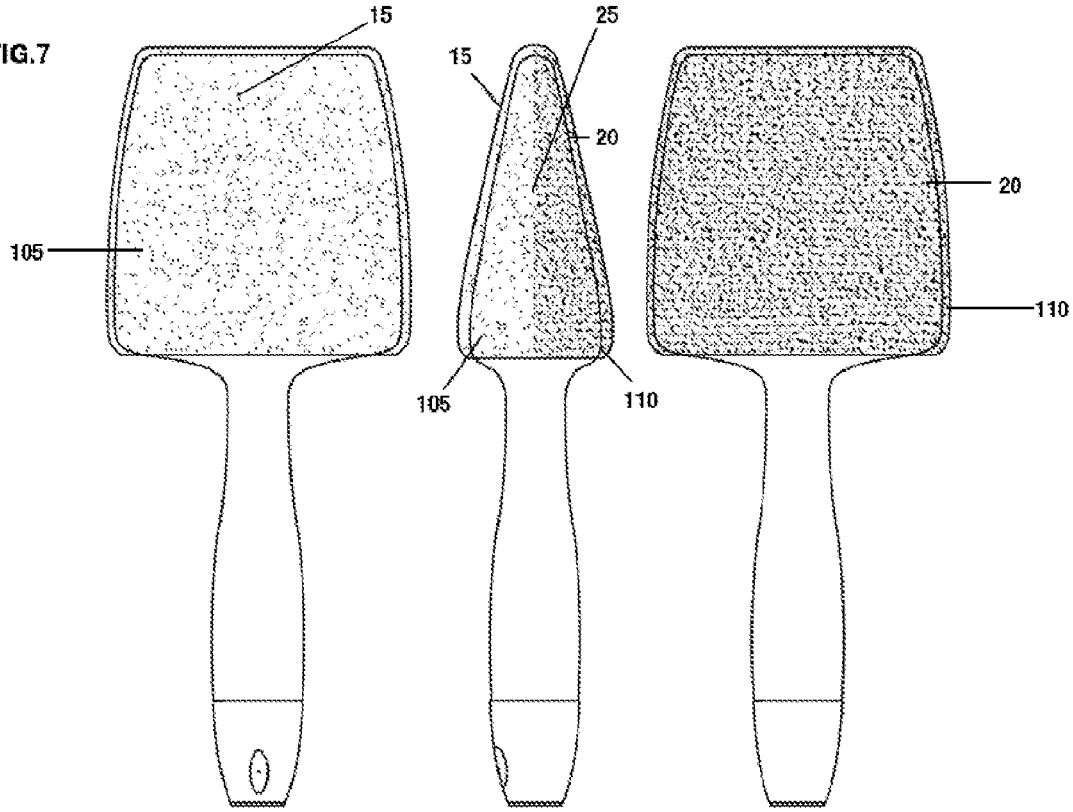
FIG. 7 is a front, side, and rear elevation view of one embodiment of the present apparatus with different microfiber surfaces on portions of the apparatus head.

In FIG. 7, microfiber 105 is on first surface 15 and a portion of first side surface 25 a portion of second side surface 30, and a distinct microfiber 110 or terry cloth towel material (not shown) is on second surface 20 and a portion of first 25 and second 30 side surfaces.

Figure 8:
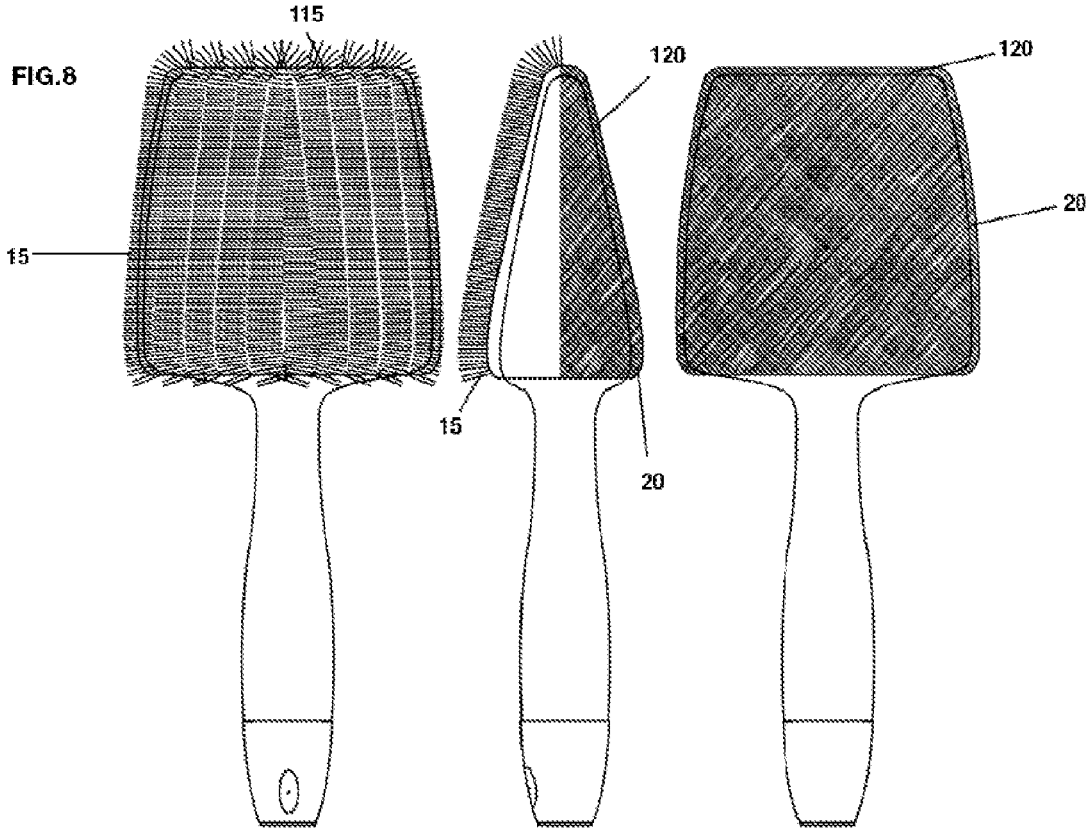
FIG. 8 is a front, side, and rear elevation view of one embodiment of the present apparatus demonstrating a metal brush, and an abrasive surface, such as abrasive pad, cover or be affixed to a second surface.

FIG. 8 demonstrates first surface 15 covered with metal brush 115, an abrasive surface, such as abrasive pad 120, cover or be affixed to second surface 20 and a portion of first 25 and second 30 side surfaces. This embodiment may be useful as a heavy cleaning scouring tool for cleaning heavily soiled, non-delicate surfaces, such as a grill, oven, and the like; internal reservoir of handle 15 may be filled with a appropriate solutions such as grill cleaning solution or with sprayable cooking product designed to prevent food sticking to a grill surface.

Figure 9:
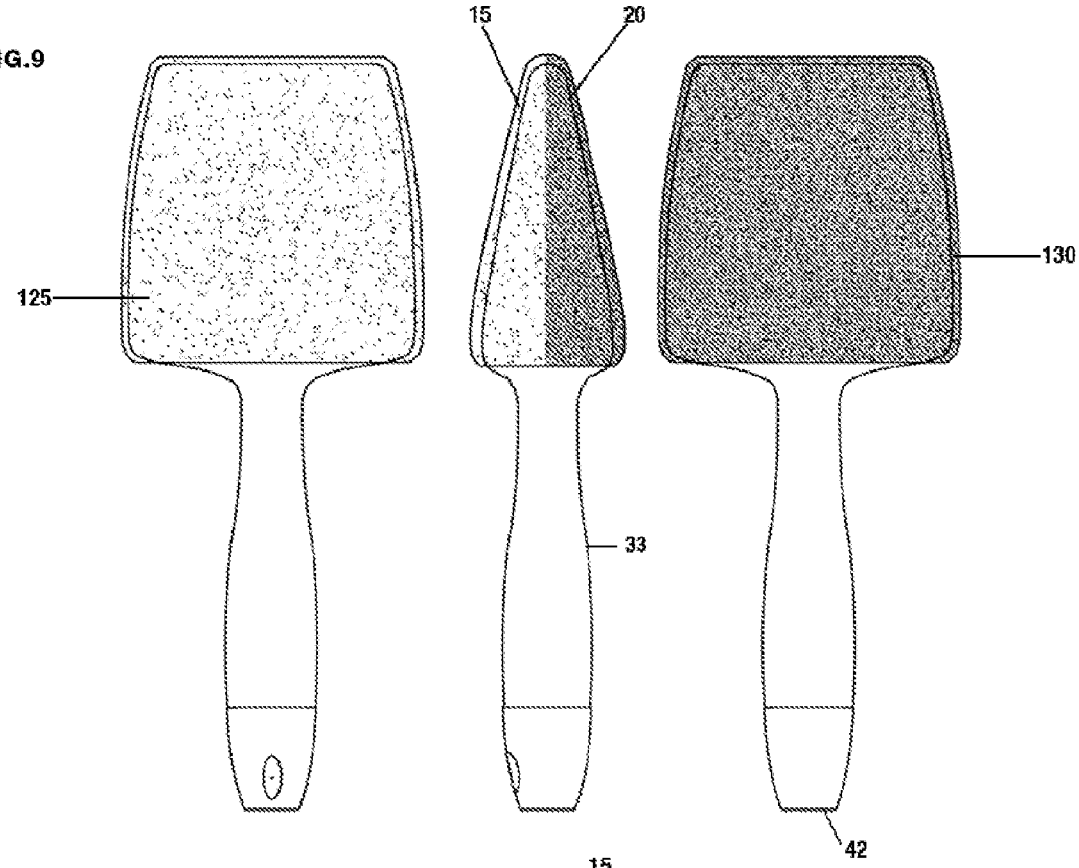
FIG. 9. is a front, side, and rear elevation view of an embodiment of the present invention depicting a felt pad covering first surface and the first side surface of the apparatus head, and a microfiber pad covering second surface and second side surface of another portion of apparatus head.

Considering now FIG. 9, felt pad 125 covers first surface 15 and a portion of first side surface 25 and second side surface 30. Microfiber pad 130 covers second surface 20 and a portion of first 25 and second 30 side surfaces. In this particular embodiment, internal reservoir of handle 33 may be filled with a cleaning solution, such as a sprayable whiteboard cleaning product, and the felt pad combined with the microfiber surface permit either dry erasing or wet cleaning one apparatus. Further, side surface 25 and 30 permit more localized erasing/cleaning, and apex 135 permits precision erasing, drying, and cleaning.

Figure 10:
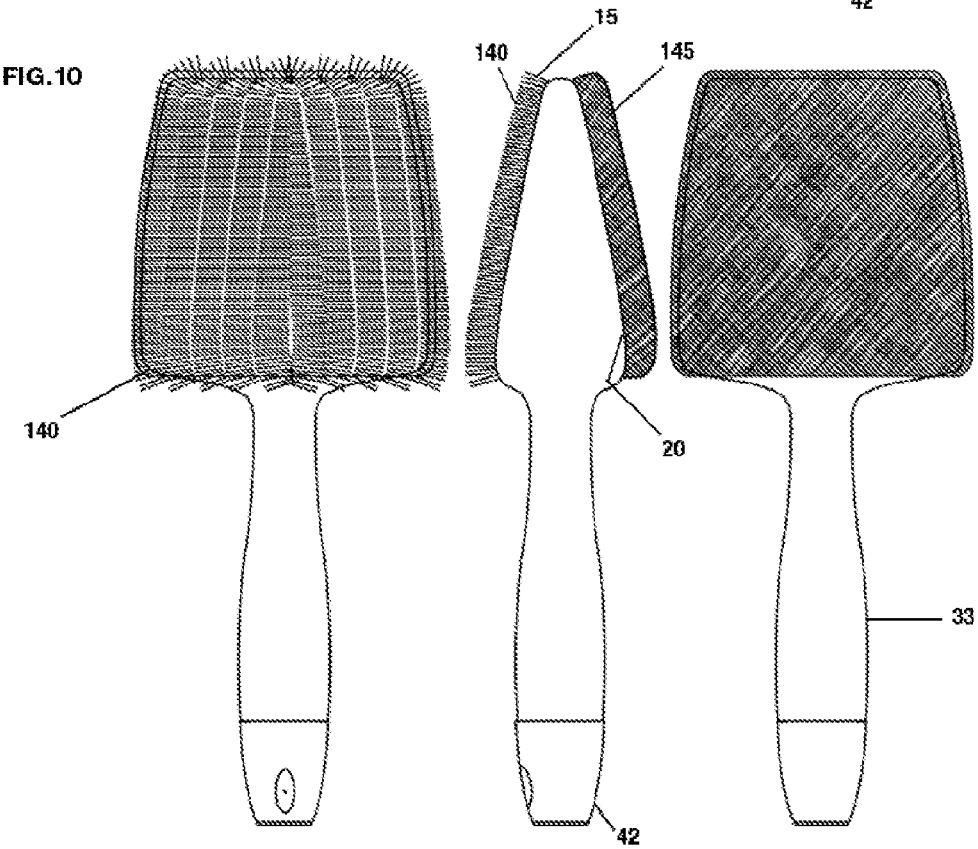
FIG. 10 is a front, side, and rear elevation view of an embodiment of the present invention depicting a soft brush covering a first surface and semi-abrasive pad covering a second surface of the apparatus head.

FIG. 10 illustrates a soft brush 140 covering first surface 15 and semi-abrasive pad 145 covering second surface 20. One use of the particular embodiment is for removing paint, grease, driveway spots, dried latex, adhesive or other stubborn substances. Accordingly, internal void of handle 33 may be filled with a variety of stain removers, degreasers, solvents, or adhesive removers.

Figure 11:
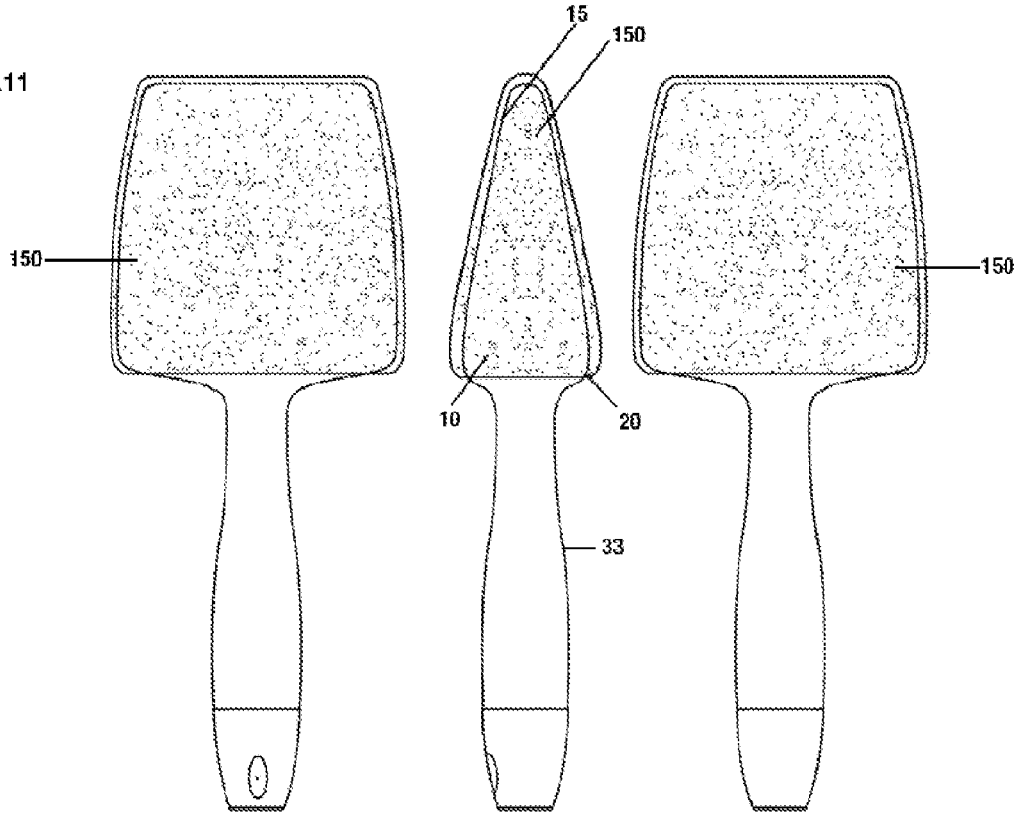
FIG. 11 is a front, side, and rear elevation view of an embodiment of the present invention illustrating a reversible, machine washable, perimetrically elastacized microfiber pouch on apparatus head.

FIG. 11 illustrates a uniform covering 50 such as a microfiber cover 150 or terry cloth on head 10. Importantly, covering 150 may constitute a reversible, machine washable perimetrically elastacized microfiber pouch as described above. In the alternative, microfiber may be affixed directly on head 10. This embodiment is well suited to uses where one surface is predictably needed, such as dusting delicate surfaces, stainless steel, vinyl, leather or other occasion where an exclusively fine microfiber cloth is needed. Other solutions may include water repellant adapted for application on a vehicle windshield. Appropriate substances are retained in the internal void of handle 33 and dispensed as needed either through pump 40 or sprayer 42 depending on the specific circumstances such as viscosity and volume of desired product. The contained product will be dependent on the target surface to be cleaned and may, by example only, include wax, dust remover/attractant, glass cleaner, stainless steel cleaner, computer monitor/plasma television cleaning solutions, optical lens cleaning solutions, and the like.

Figure 12:
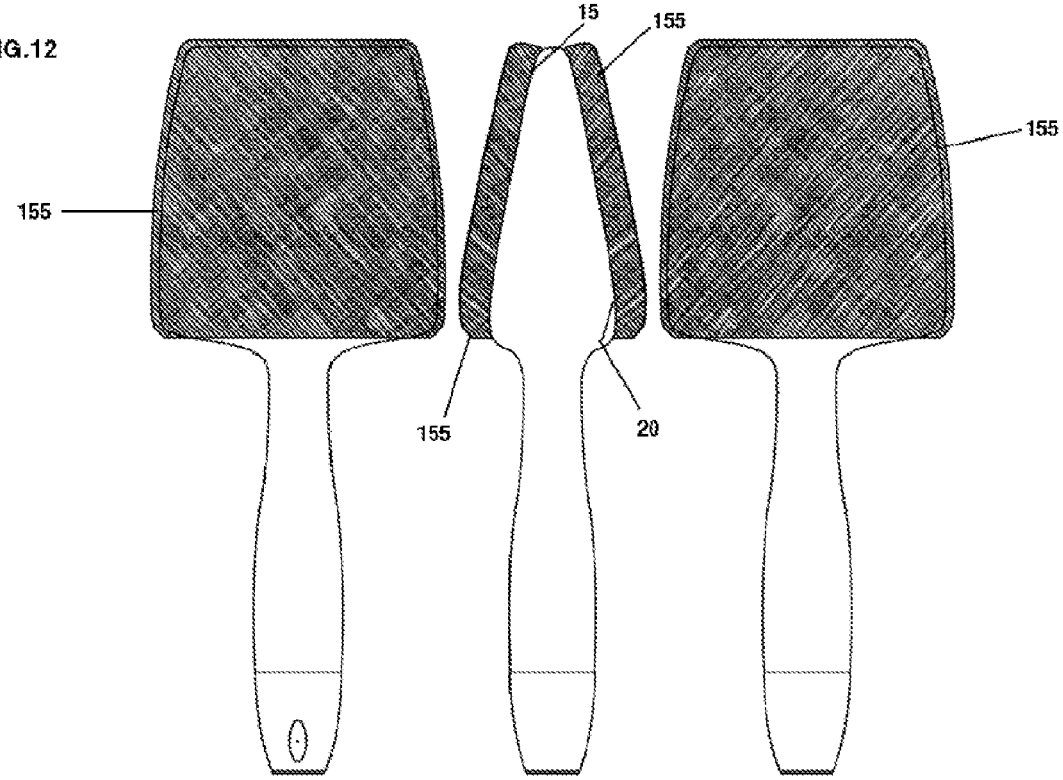
FIG. 12 is a front, side, and rear elevation view of an embodiment of the present invention illustrating semi-abrasive or abrasive padding covering or affixed to apparatus head.

FIG. 12 illustrates an embodiment adapted for rust removal or heavy use, including outdoor furniture cleaning Semi-abrasive or abrasive padding 155 covers or is alternatively affixed to first 15 and second 20 surface, and reservoir of handle 33 contains flowable rust removing and/or cleaning product.

Figure 13:
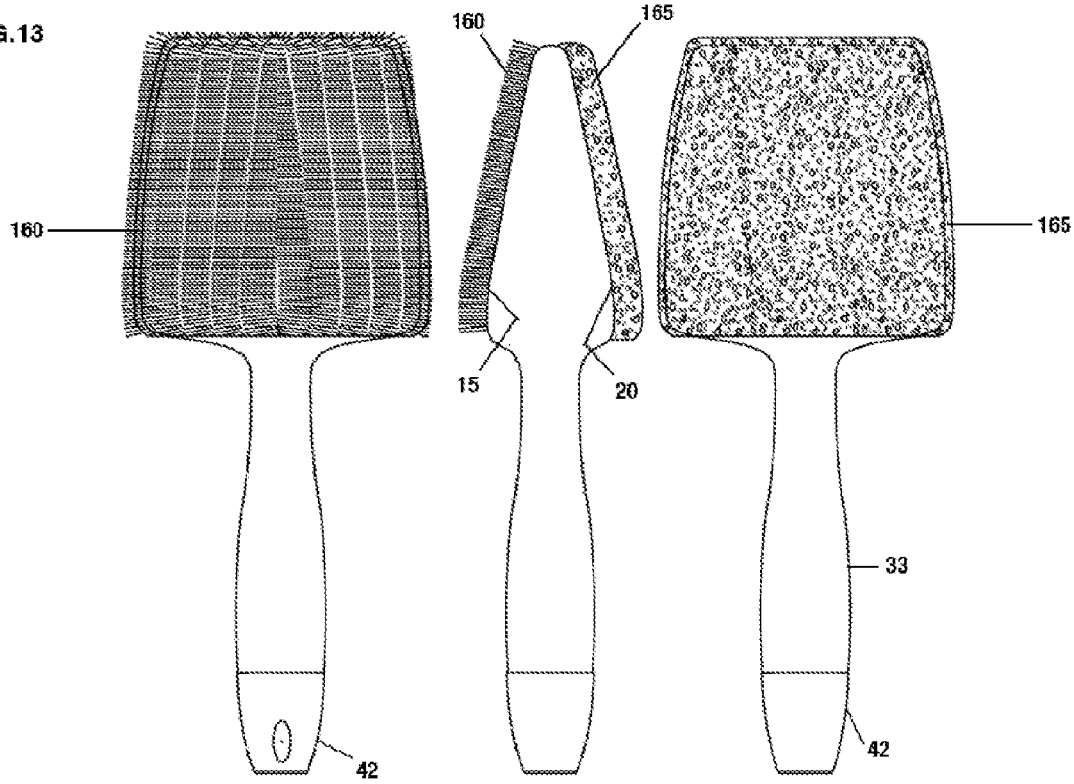
FIG. 13 is a front, side, and rear elevation view of an embodiment of the present invention showing brush covering first surface and soft sponge covering second surface of apparatus head.

In FIG. 13, brush 160 covers first surface 15, soft sponge 165 covers second surface 20. This embodiment apparatus may be useful for instances where scrubbing is required with an absorbent surface, such as tile cleaning, wherein appropriate cleaning and scrubbing solution is contained in reservoir of handle 33 and dispensed by pump 40 or spray 42.

Figure 14:
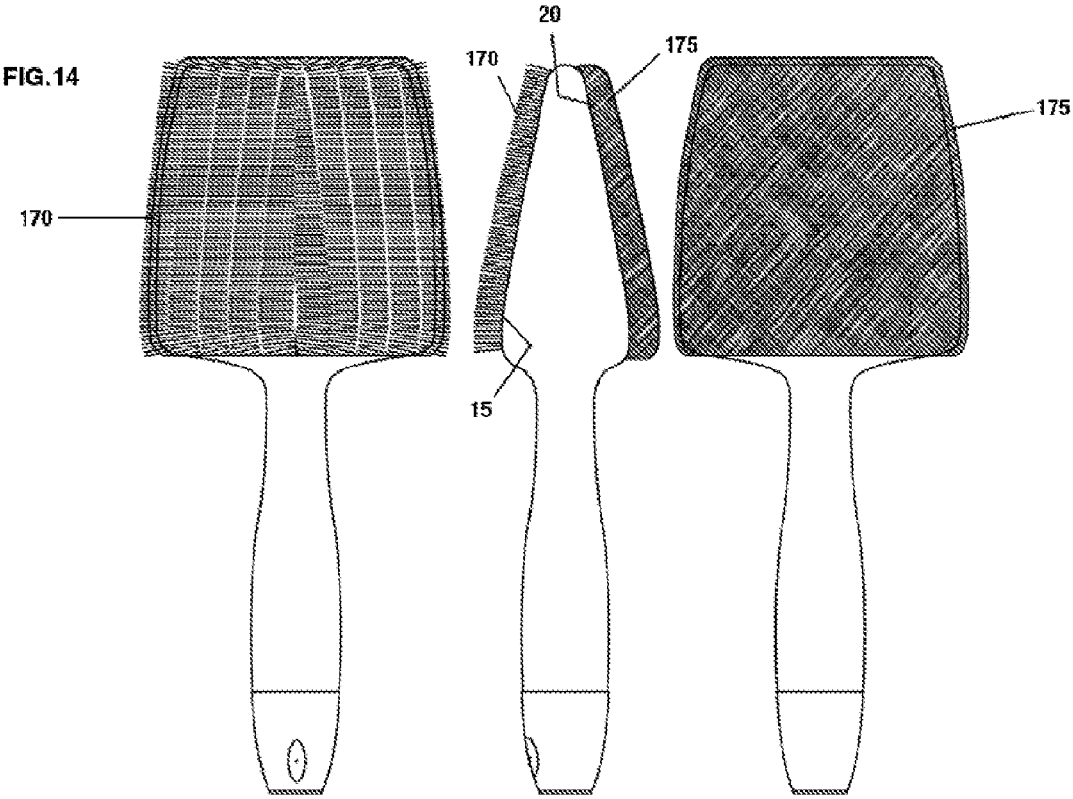
FIG. 14 is a front, side, and rear elevation view of an embodiment of the present invention illustrating a portion of apparatus head covered by brush and second portion covered by semi-abrasive pad.

FIG. 14 first side 15 is covered by brush 170 and second side 20 covered by semi-abrasive pad 175. This embodiment may be well adapted for cleaning pool tiles and vinyl.

Figure 15:
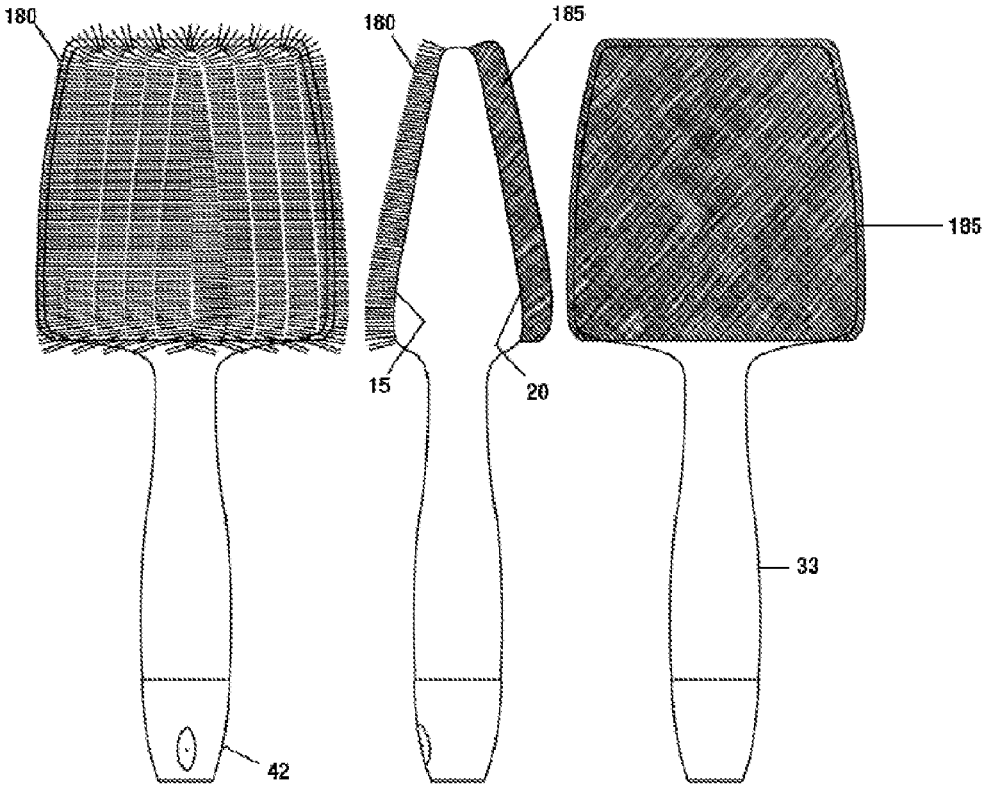
FIG. 15 is a front, rear, and side elevation view of an embodiment of the present invention illustrating a stiff bristle brush cover on the first surface and abrasive pad on the second surface of the apparatus head.

FIG. 15 illustrates an embodiment apparatus, wherein stiff bristle brush 180 covers first surface 15, and abrasive pad 185 covers second surface 20. This embodiment may be particularly useful as a heavy cleaner and rust remover.

Figure 16:
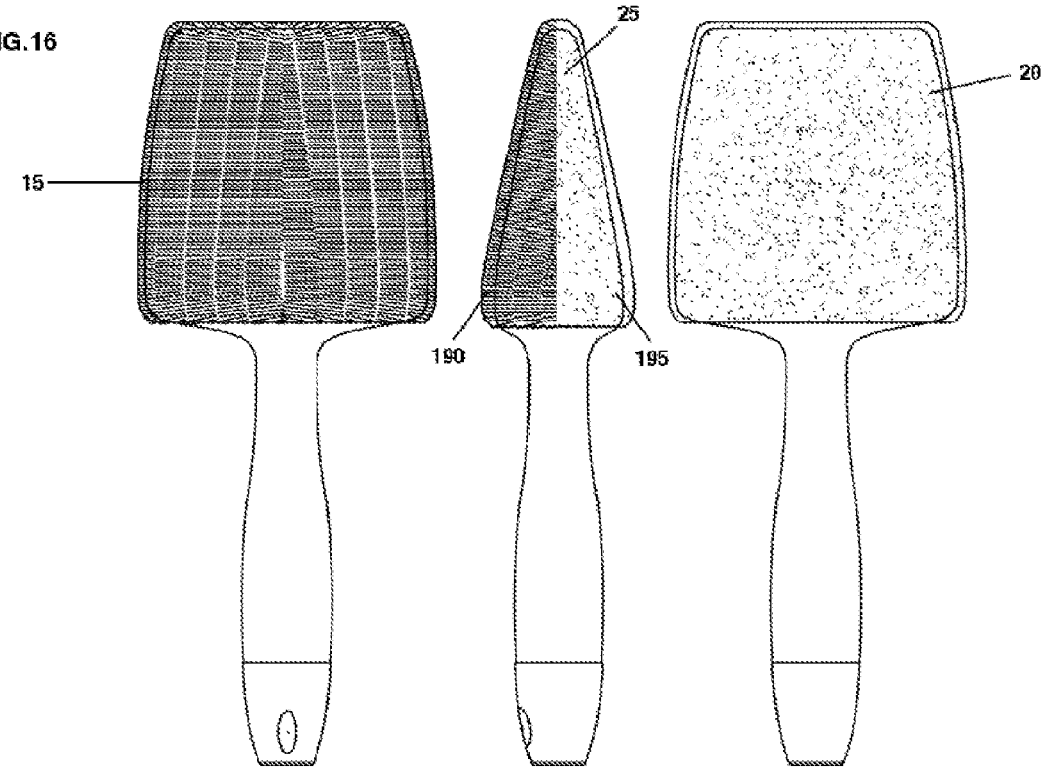
FIG. 16 is a front, side, and rear elevation view of an embodiment of the present invention illustrating a soft brush on the first surface and a portion of the first and second side surface and a microfiber cloth on the second surface and a portion of the first and second side surfaces of apparatus head.

FIG. 16 first surface 15 and a portion of first 25 and second 30 side surfaces are covered by a soft brush 190, second surface 20 and a portion of first 25 and second 30 second side surfaces are covered by a soft microfiber cloth 195. This embodiment may be particularly useful for shining, glossing, or repairing dress or athletic shoes, wherein reservoir of handle 33 contains sprayable shoe polish, cleaner, or protectant, and may be used to apply and distribute various dye and repair products.

Figure 17:
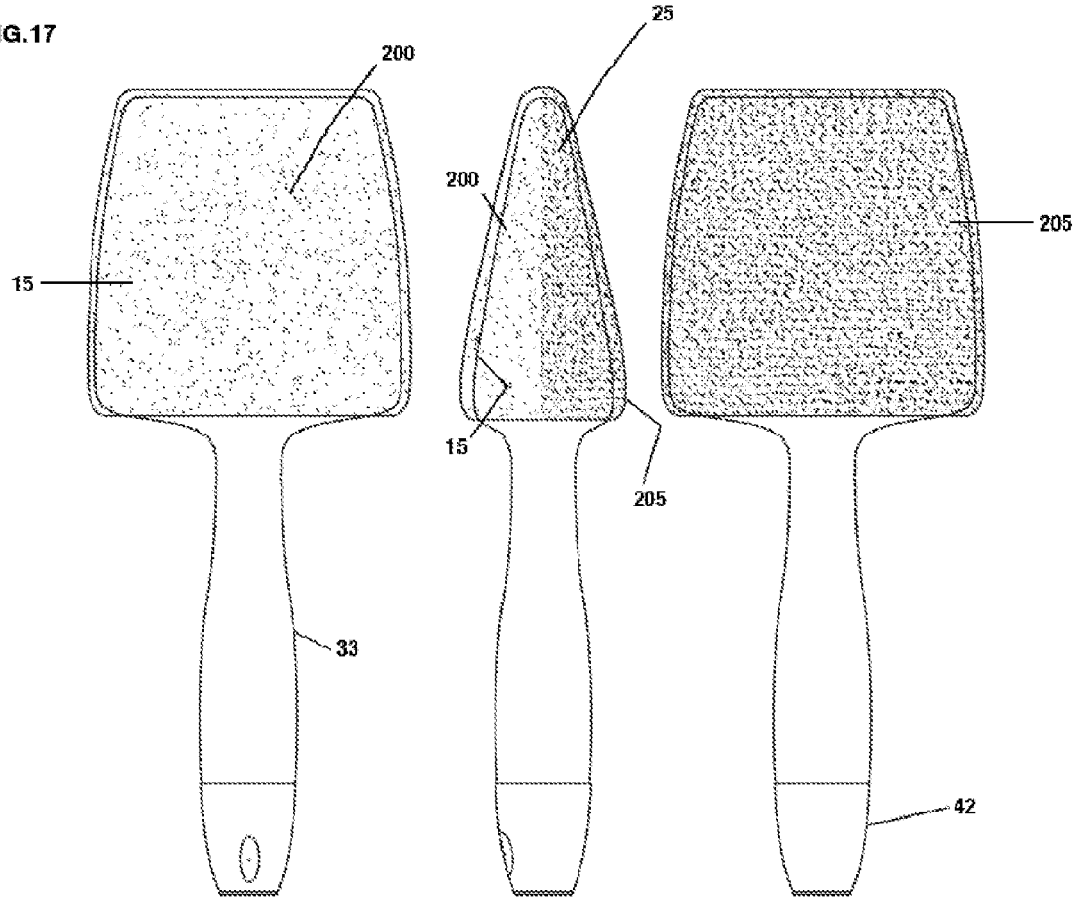
FIG. 17 is a front, side and rear elevation view of an embodiment of the present invention depicting the first surface and portion of the first and second side surfaces covered by a thick microfiber pad, and second surface and portion of first and second side surfaces are covered by a terry cloth towel material.

FIG. 17 first surface 15 and a portion of first 25 and second 30 side surfaces are covered by a thick microfiber pad 200. Second surface 20 and a portion of first 25 and second 30 side surfaces are covered by a terry cloth towel material 205. This embodiment may be adapted for cleaning and polishing chrome, brass, or other metallic surfaces with appropriate metal cleaning, polishing material in handle 33's reservoir.

Figure 18:
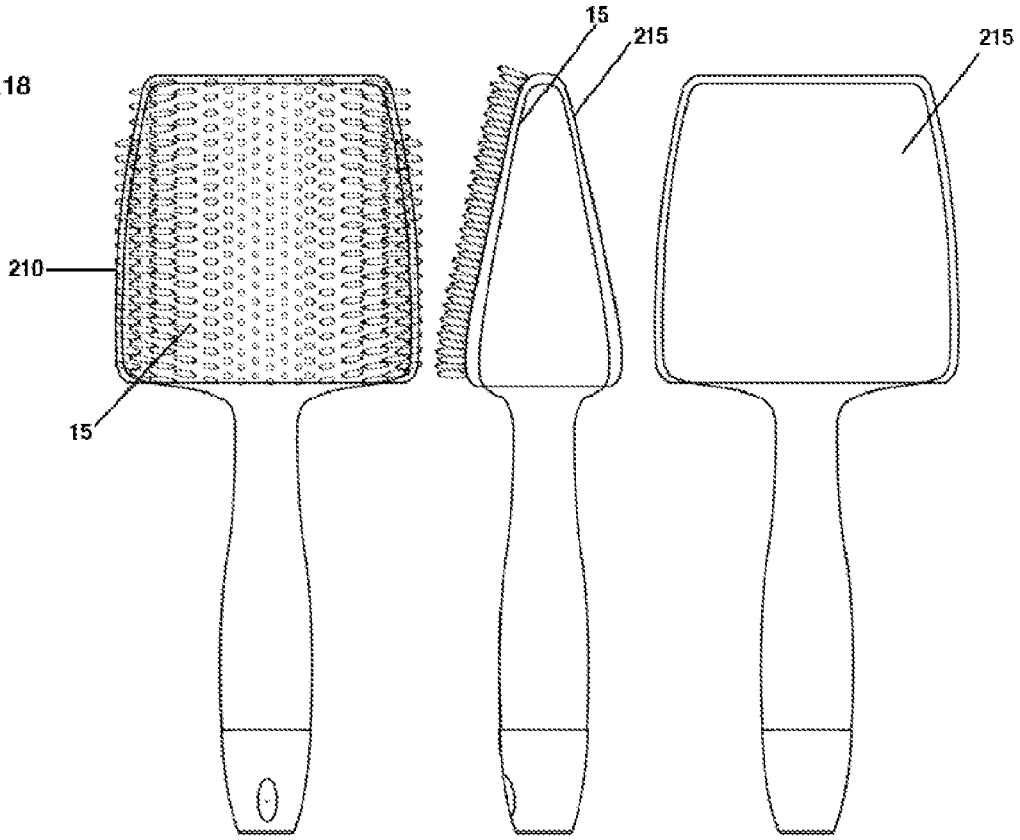
FIG. 18 is a front, rear, and side elevation view of an embodiment of the present invention depicting a separated bristle brush covering first surface and a tacky pad covers second surface of apparatus head.
Figure 19:
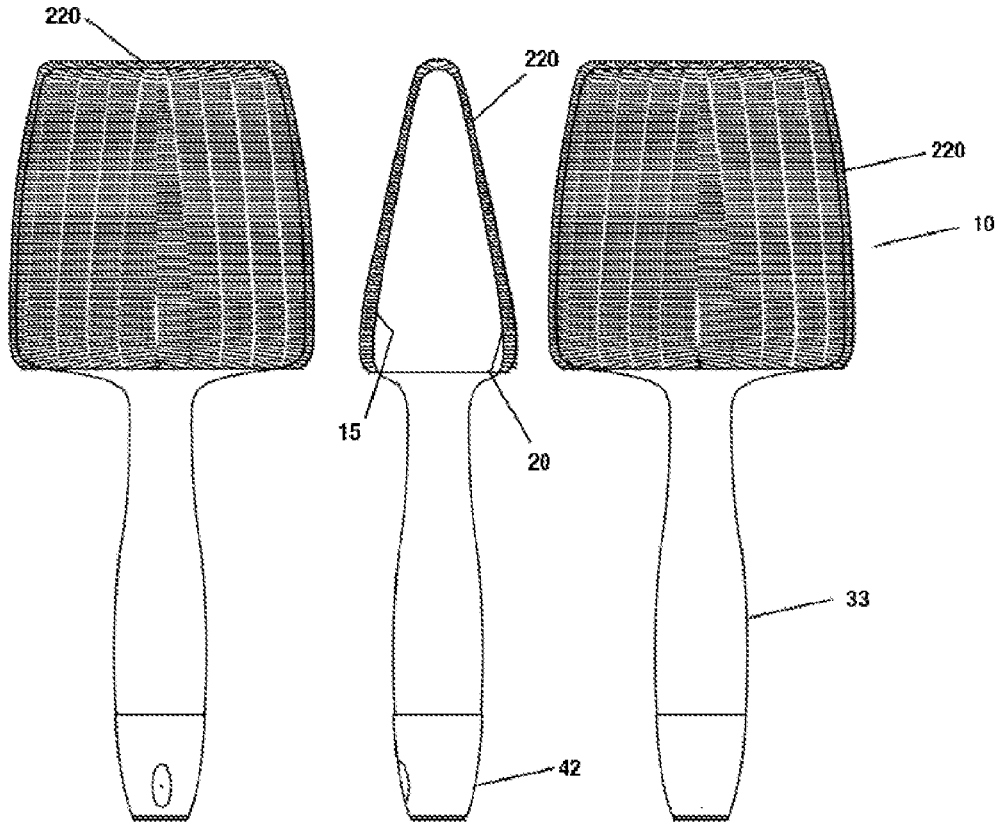
FIG. 19 is a front, rear, and side elevation view of an embodiment of the present invention depicting a soft bristle brush on first and second surface of apparatus head.

In FIG. 18 a separated bristle brush 210 covering first surface 15 and tacky pad 215 covers second surface 20. FIG. 19 may be advantageously utilized as a pet cleaning and grooming device. Flowable cleaners, deodorizers, medicaments, fragrants, and the like may be contained in the reservoir of handle 33 and dispensed therefrom.

FIG. 19 illustrates soft bristle brush 220 on first 15 and second 20 surface of head 10 which may be adapted for use as a laundry spot treatment brush.

Figure 20:
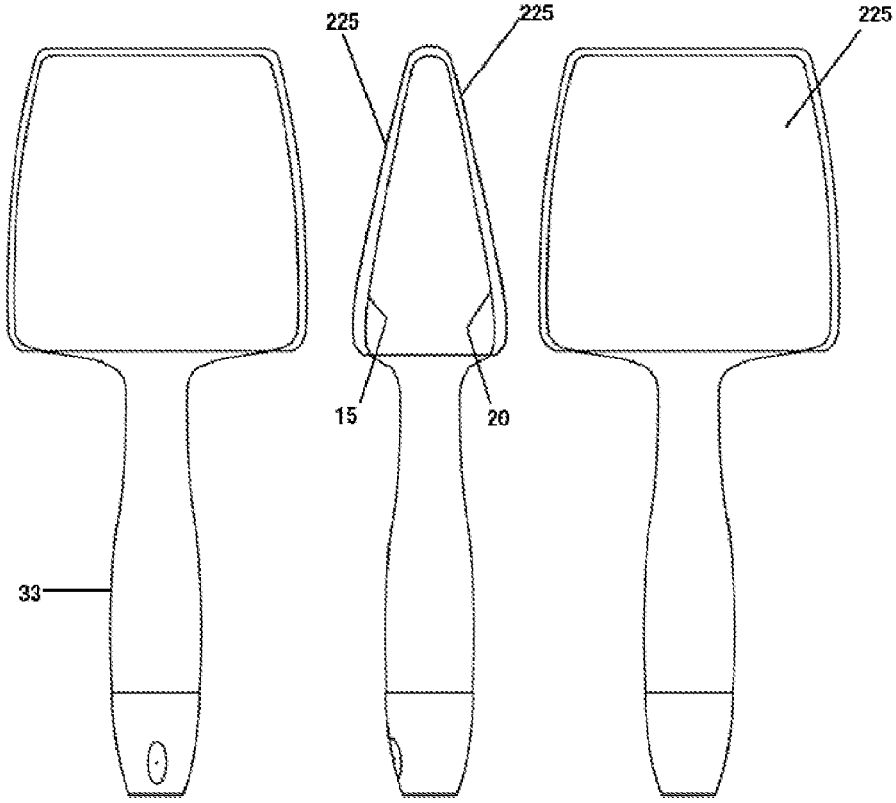
FIG. 20 is a front, rear and side elevation view of an embodiment of the present invention depicting a soft, white, haired flocked pad covering first and second surface of apparatus head.

Turning now to FIG. 20 soft, white, haired flocked pad 225 covering first 15 and second surface 20 of head 10. In another embodiment, a flocked pad covers entire head 10. This embodiment may be adapted to apply and distribute craft paint and glaze contained in the reservoir of handle 33.

Figure 21:
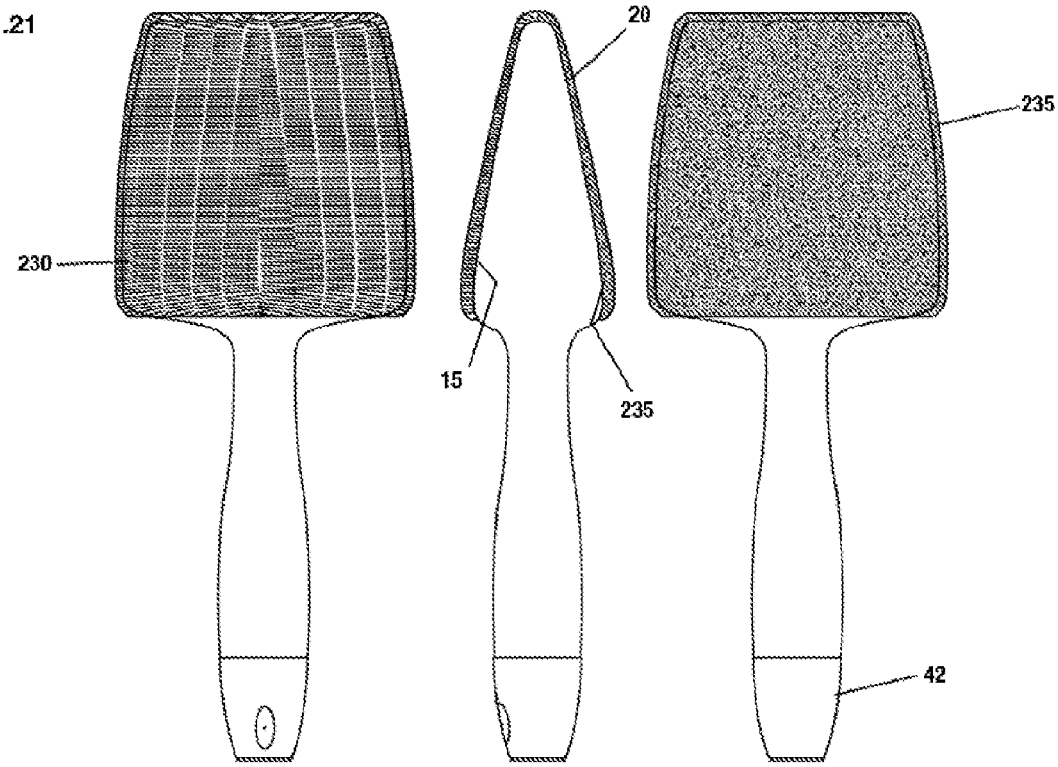
FIG. 21 is a front rear and side elevation view of an embodiment of the present invention depicting a soft fine brush that covers the first surface and a soft exfoliating pad that covers second surface of apparatus head.

FIG. 21 soft fine brush 230 covers first surface 15 and soft exfoliating pad 235 covers second surface 20. Medicaments, lotions, salves, balms, or other flowable product may be contained in reservoir of handle 33 and dispensed by pump 40 or spray 42 dispenser depending on viscosity and desired volume and dispersion or dispensed product.

Figure 22:
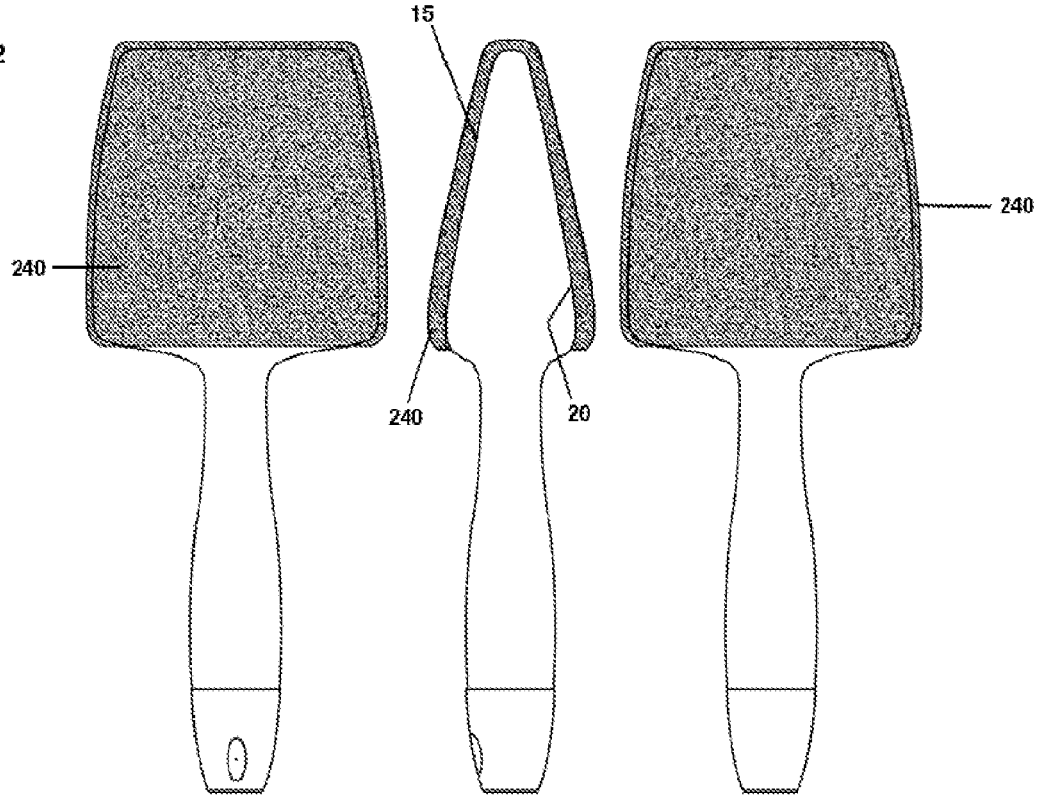
FIG. 22 is a front and side and rear elevation view of an embodiment of the present invention depicting a wet sander having removable and replaceable soft foam sandpaper that covers first and second surfaces of apparatus head.

In FIG. 22, a wet sander having removable and replaceable soft foam sandpaper 240 covers first 15 and second 20 surfaces of head 10. This embodiment is useful for autobody work.

Figure 23:
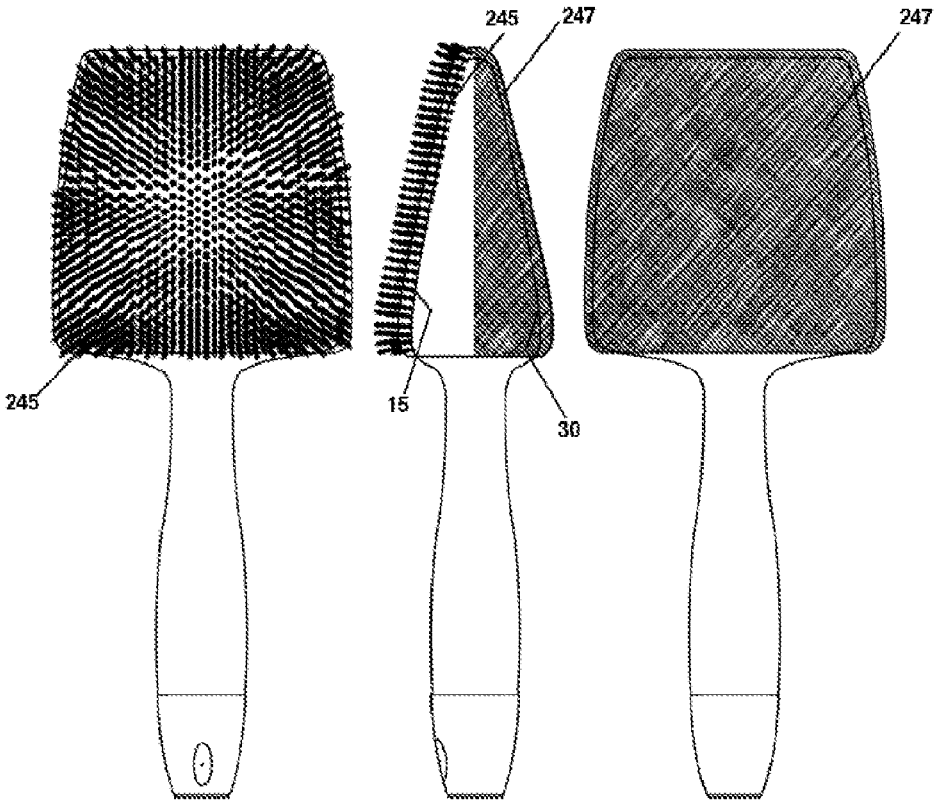
FIG. 23 is a front, rear and side elevation view of an embodiment of the present invention depicting a plastic or rubberized brush covering first surface, and a semi-abrasive pad covering second surface, and a portion of second side surface of apparatus head.

In FIG. 23, a plastic or rubberized brush 245 covers first surface 15, and a semi-abrasive pad 247 covers second surface 20, and second side surface 30. This embodiment may be well adapted for removing certain adherent matter, such as insects on a windshield. The reservoir of handle 33 may contain an automotive cleaning fluid bug and tar remover.

Figure 24:
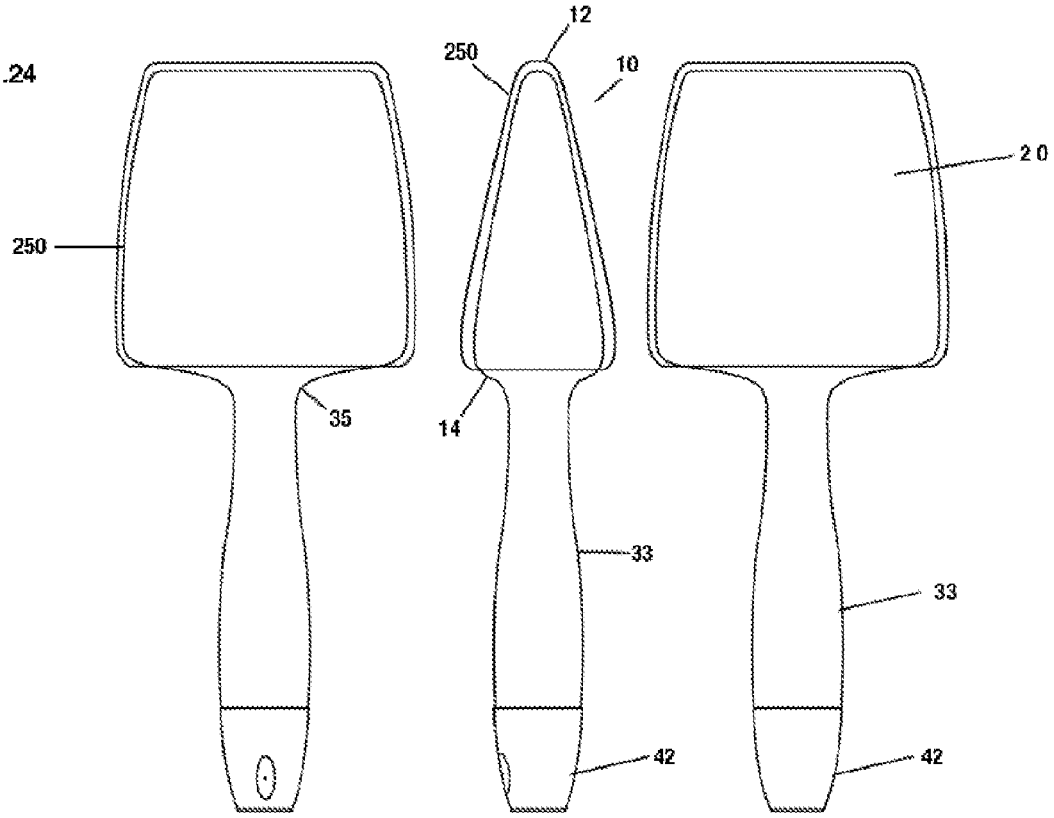
FIG. 24 is a front, rear, and side elevation view of an embodiment of the present invention depicting a melamine foam covering surfaces of the apparatus head.

In FIG. 24 a melamine foam 250 may cover first 15 and second 20 surfaces of head 10 or adapted to cover head 10 entirely.

Figure 25:
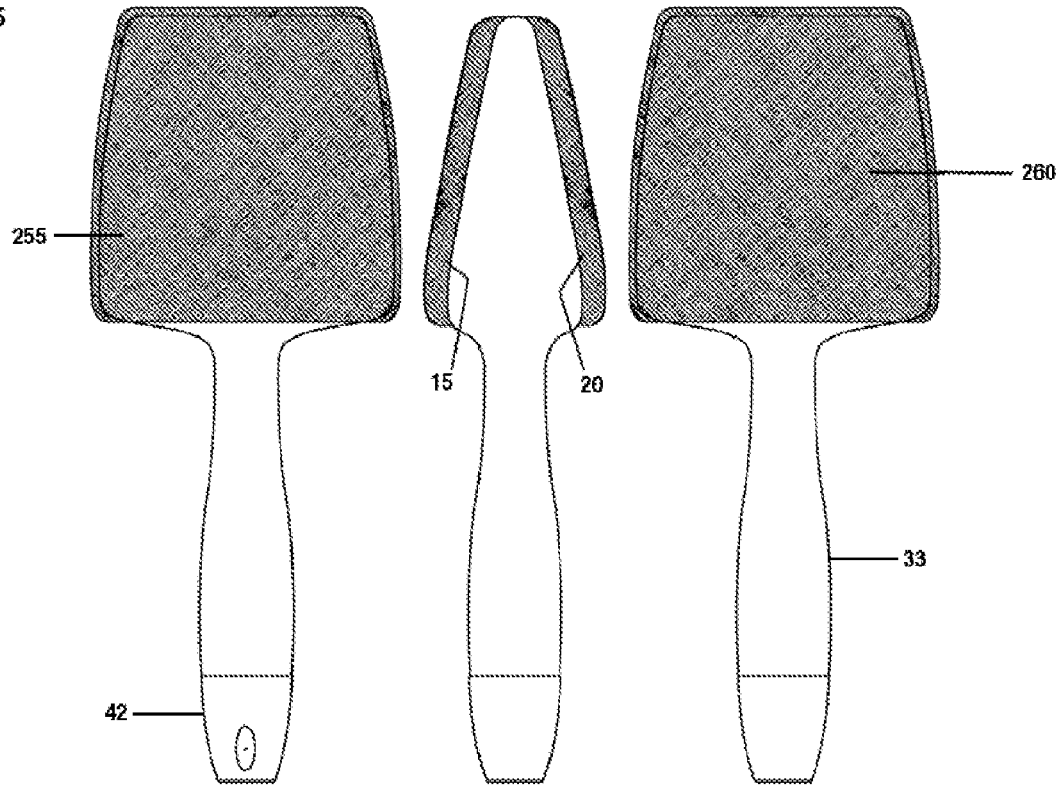
FIG. 25 is a front, rear, and side elevation view of an embodiment of the present invention depicting the apparatus head first surface covered in sandpaper and second surface covered by a polishing brush.

In FIG. 25 first surface 15 is covered in sandpaper 255, and second surface 20 is covered by a polishing brush 260. This embodiment may be well adapted to cleaning and polishing the hoofs of horses and other ungulates.

Figure 26:
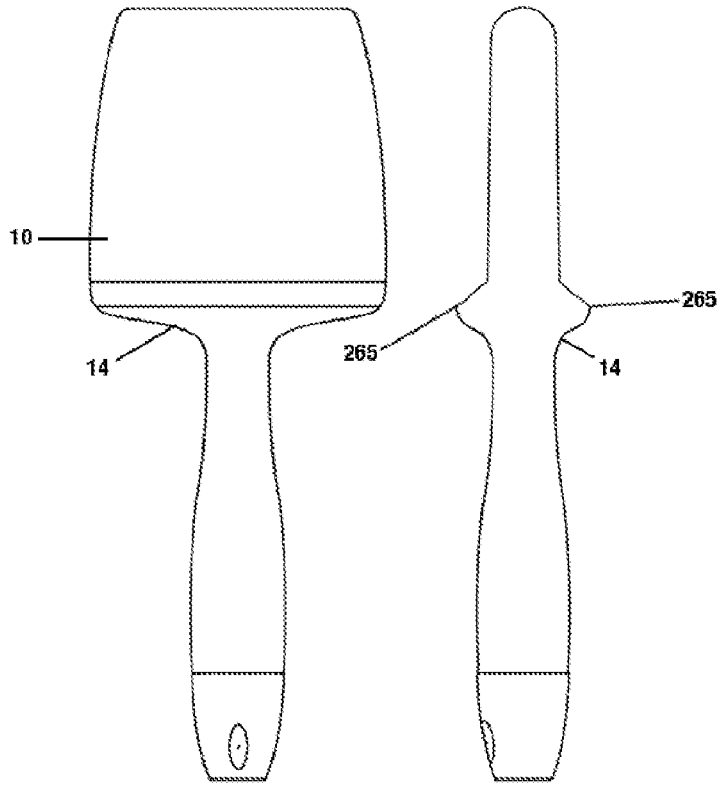
FIG. 26 is a front and side elevation view of an embodiment of the present invention depicting flared shape at the base of the apparatus head.
Figure 27:
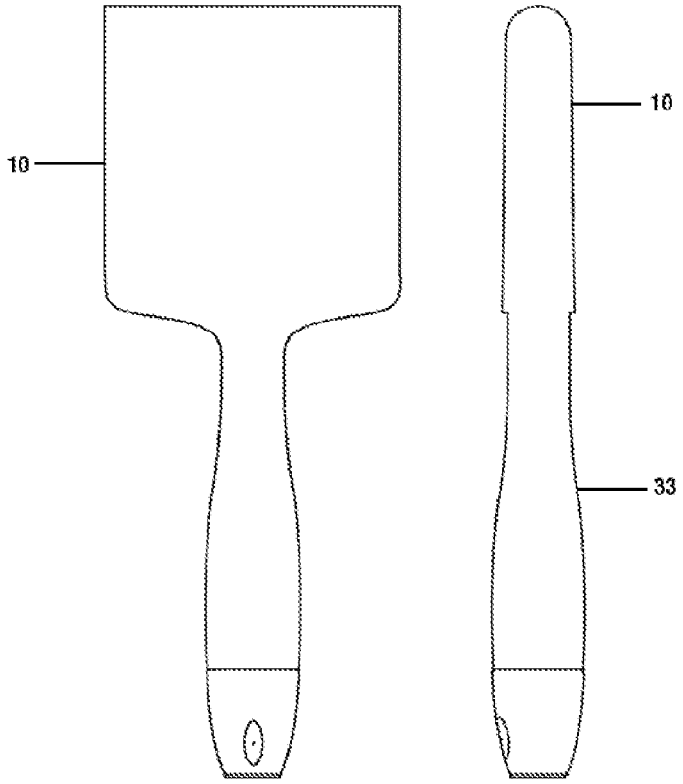
FIG. 27 is a front and side elevation view of an embodiment of the present invention depicting a non-tapered and uniform apparatus head.

FIG. 26 head 10 is shaped to be flared 265 at base 14. This adaptation may permit head 10 to be inserted into uniformly shaped places (e.g. between window blinds, bookcases, etc.). FIG. 27 head 10 is non-tapered and uniform and is thus able to fit in relatively tight spaces.

Figure 28:
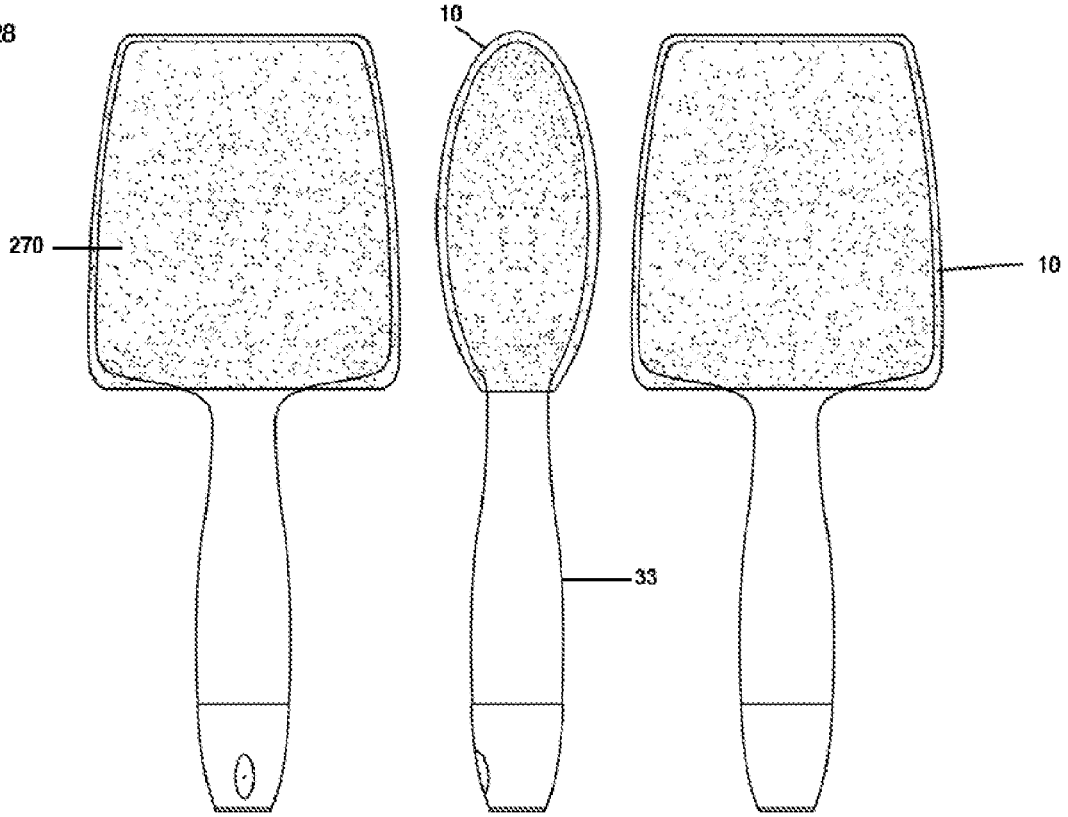
FIG. 28 is a front and side elevation view of an embodiment of the present invention depicting shaped to have an elliptical cross-section and optional microfiber cloth covering the entire surface of apparatus head.

FIG. 28 head 10 is shaped to have an elliptical cross-section and illustrates an optional microfiber cloth 270 covering the entire surface of head 10.

Figure 29:
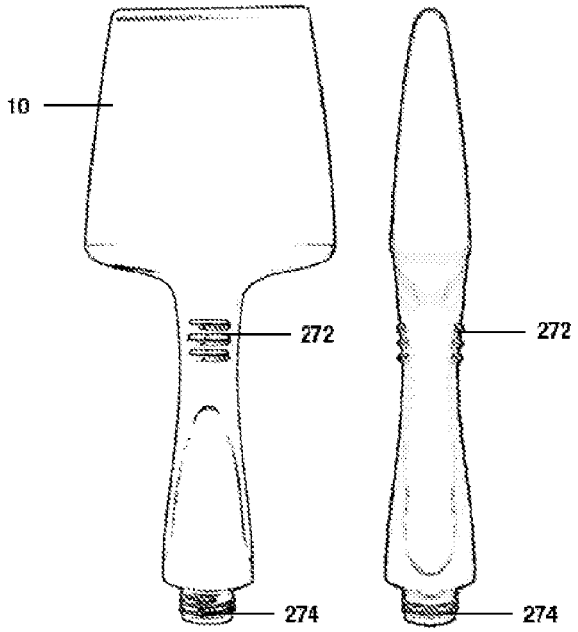
FIG. 29 is a front and side elevation view of an embodiment of the present invention illustrating an alternative embodiment head shape where the lateral aspect of apparatus head is shaped to form a modest wedge and ridges are located on all sides of apparatus handle just before neck, and optional screw top.

In FIG. 29 illustrates an alternative embodiment head shape where the lateral aspect of head 10 is shaped to form a modest wedge. Ridges 272 are located on all sides of handle 33 just before neck to provide fraction for thumb and finger when held by user. Ridges 272 aid in providing a slip resistant grip and chiefly make contact with the user's thumb and index finger, but could aid in providing better handling when placed in contact with any surface of the user's hand. While illustrated on certain embodiments, ridges 272 can be utilized in any embodiment described in this application. Further, in one embodiment, handle 33 contains a threaded portion 274 to accommodate at cap, and the internal reservoir of handle 33 may be accessed by unscrewing top to expose liquid, solid, or semisolid contents therein.

Figure 30:
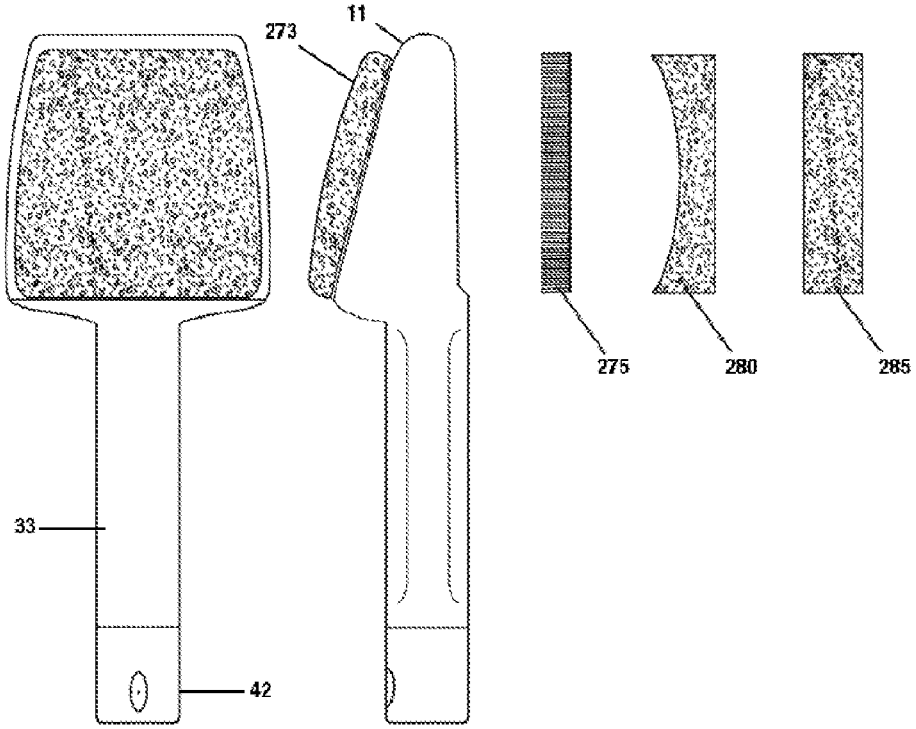
FIG. 30 is a front and side elevation view of an embodiment of the present invention depicting illustrates an alternative single surface embodiment wherein head has a plurality of attachable surfaces.
Figure 31:
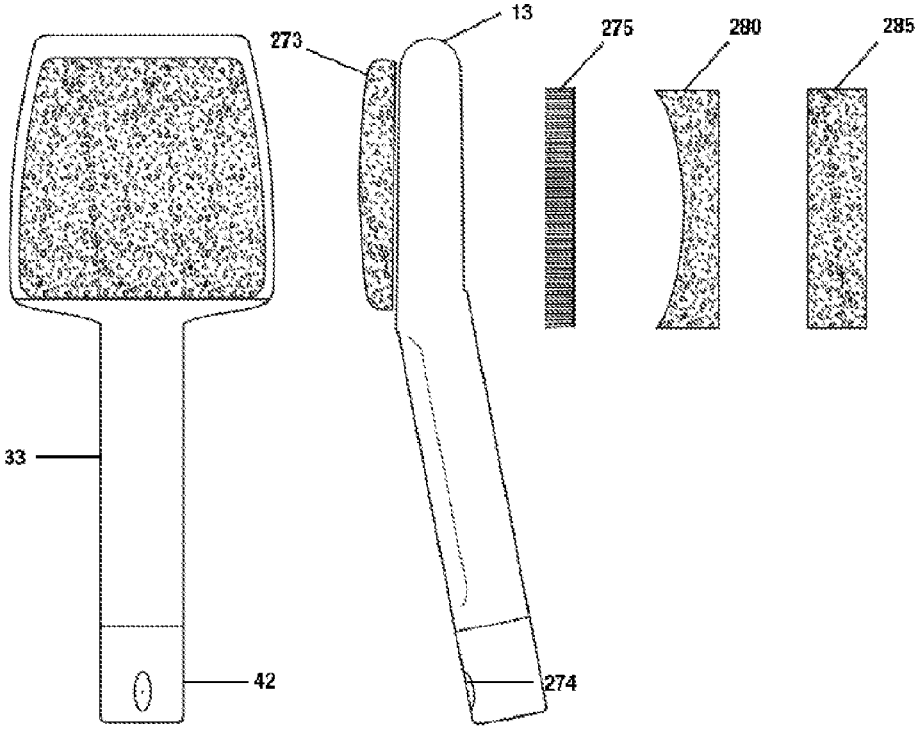
FIG. 31 is a front and side elevation view of an embodiment of the present invention depicting an alternative single surface embodiment wherein head has a plurality of attachable surfaces

FIG. 30 illustrates an alternative single surface embodiment wherein head 11 has a plurality of attachable surfaces including a curved sponge 273, brush 275, concave sponge 280, and rectangularly shaped sponge 285. FIG. 31 illustrates an alternative single surface embodiment wherein head 13 is angled away from the target cleaning surface.

FIG. 32-34 illustrate various alternative embodiments. Pump 40 or spray 42 dispenser may be enclosed within flip top 290 covering said dispenser, having a scrubber pad 295 on its surface. In one embodiment, cover 300 may be folded over head 10 and VELCRO pad 310 (shown through cover 300) reversibly affixed to first 15 and second 20 surfaces—VELCRO pad 310 surface affixed on head 10 and the second VELCRO sewn into the inside portion of the microfiber cover 300 (not shown). Where VELCRO pad 310 adequately affixes microfiber cover 300 itself, no VELCRO need be attached or sewn in the inside portion of cover 300. In one embodiment cover 300 may have a wet side 315 and dry side 320. Pull tabs 325 are located on the terminal ends of cover 330 and assist in overcoming resistance in removing cover 300 from affixation to VELCRO pad 310. A center fold-over zone 330, which may be comprised of fabric, rests on the apex 12 of head 10. Strap hook 335 attaches to loop 370 (see FIG. 37) and may permit apparatus 5 to be suspended on the wall, toolbelt, or other location when not directly in use. In one embodiment, microfiber pads may be color coded to correspond the wet and dry sides. As with other embodiments of the present invention previously discussed, connecting cover 330 may be machine washable, changeable, and reversible. In some embodiments where corresponding VELCRO is not attached, cover 330 when soiled, may be inverted and used again; this provides four cleaning/drying/polishing surfaces. It should be noted that although VELCRO is used as an example of a fiber locking embodiment, any material which is flexible and permits reversible engagement between said head and said cover 300 may be utilized.

Figure 36:
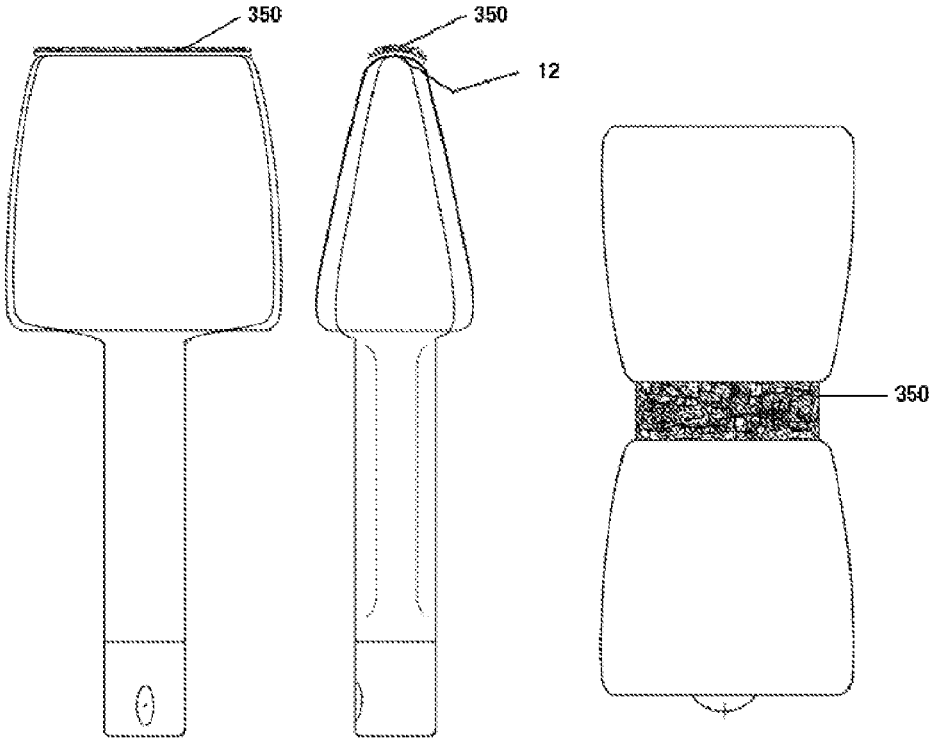
FIG. 36 is a front and side elevation view of an embodiment of the present invention and a top view of an embodiment covering.

Further, turning now to FIG. 36, scrubber 350 is mounted on connecting cover 330 which covers at least a portion of apex 12. In may be integrated into fabric on cover 50. Alternatively, optional scrubber bar 350 is affixed to apex 12 on head 10 pass through opening that may be located on 330 (not shown).

Figure 35:
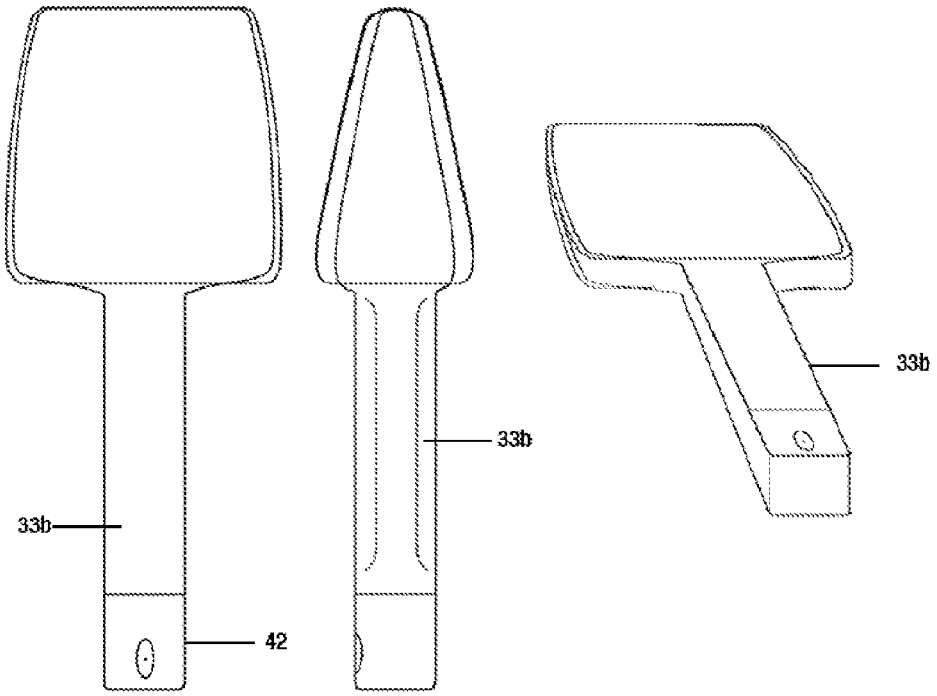
FIG. 35 is a front and side elevation view and a rear perspective view of an embodiment of the present invention illustrating a square handle embodiment.

Turning now to FIG. 35, an alternative embodiment squared handle **33*b*** is illustrated. This embodiment may permit the apparatus to be more stably rested on certain surfaces, such as a ladder without the risk of rolling.

FIG. 36 illustrates an alternative embodiment where scrubber pad 350 is mounted on the surface of cover 330.

It should be noted that the reservoir in handle 33 is refillable, and the apparatus is reusable, however, it is possible for apparatus may be made for single use purposes. It should also be noted that apparatus 5 may be made in a variety of shapes and sizes without departing from the spirit and scope of the invention. Handle 33 may be formed into a variety of shapes and sizes to accommodate different fluids and different size hands or handholding techniques.

It should be noted that the various coverings including brushes, microfiber, cloth, sponge, as well as abrasive and scouring surfaces may be formed integrally with head 10 or may be irreversibly separately affixed during product manufacture. Further, the various coverings may be reversibly attached by locking materials such as VELCRO.

The composition of solution placed in handle 33 is varied and includes any material useful on a target surface of interest. Dispensing means include pump 40, spray 42, and in one embodiment a screwable cap (not shown) substituted for a dispensing means, permitting access material therein.

Handle 33 and head 10 may be formed a single blow molded structure, or may be formed in parts and fused or affixed during manufacture in any suitable way. Apparatus 5 may be constructed of any type of suitable thermoplastic material, urethane, glass or other material.

Regarding various coverings, it should be noted that the coverings such as microfiber may be of uniform dimension and thickness or non-uniform dimensions. Non-uniform coverings may permit bunching during cleaning, and in some cases this may be desirable (e.g. increased absorptive/collecting surface area). For all embodiments listed above, the coverings may be uniform or non-uniform. Further, coverings may comprised of a single material or a plurality of materials. In a specific embodiment, material covering, for example, first surface of head 10 may be formed of several adjoining layers of differing microfiber—each with its own characteristics.

Several different surfaces and microfiber surfaces have been disclosed above and several exist including: terry towel, waffle weave, suede microfiber, and tight weave, no pile microfiber glass cloths as mere examples. Further, different varieties of covering including long or short nap and split strands, for increased wicking, are available and provide some following exemplar qualities including: cleaning, absorptive, abrasive, agitative, attractant, and other characteristics. Aspects of the above apparatus, including apparatus shape, coverings, composition of contained flowable material, and removable/reversibility coverings (as non-limiting examples) may be utilized and practiced with any known covering to provide a cleaning, polishing instrument adapted tailored to a specific target surface.

The present invention further discloses a method of cleaning, polishing, or drying a surface of interest comprising: providing an apparatus having a head, body, first and second surface, first and second side surface, an apex and base, having a handle integrally affixed or coupled to the head, the handle having an internal void which serves as a reservoir for the storage of flowable liquid material which may be stored within the handle; a dispensing means including a pump or spray dispenser; a cleaning surface covering at least a portion of the head, and a polishing surface covering at least a portion of the head. The user selects the target surface to be cleaned or polished, orients the spray or pump dispenser oriented upright relative to the ground with the dispenser facing the target surface; actuating the dispenser resulting in flowable product deposition on the surface of interest; inverting said apparatus approximately one hundred eighty degrees such that head is upright relative to the ground and dispenser is closest to the ground; orienting the cleaning surface toward the target surface; wiping target surface with cleaning surface sufficiently to clean said surface or until product has been removed; rotating apparatus to orient polishing surface toward target surface; wiping target surface sufficiently with polishing surface until the desired polishing result is achieved, and the user desires to stop.

Cover 50 may be uniform or non-uniform. Non-uniform embodiments may be formed of different qualities of microfiber, or formed of microfiber and other material, such as terry towel cloth, sponge, abrasive pad, or other surface. As illustrated above, a uniform embodiment of cover 50 may be comprised of uniform microfiber or materials such as terry cloth, sponge, brush, or abrasive pad. Further, it should be recognized that any surface of head 10 may be covered with different or same material, and it is possible to have as many as five different surfaces—which include apex 12 of head 10 having a unique surface.

It should be noted that the term cover as applied herein in a general sense may refer to material placed on the surface of head 10 which is detachable. Cover may also refer to material integrally formed with head 10, including but not limited to a brush, sponge, abrasive surface, integrally formed with or permanently affixed to said head 10. In other embodiments, such surfaces may be mounted on one surface of a material fitted over head 10.

Figure 37:
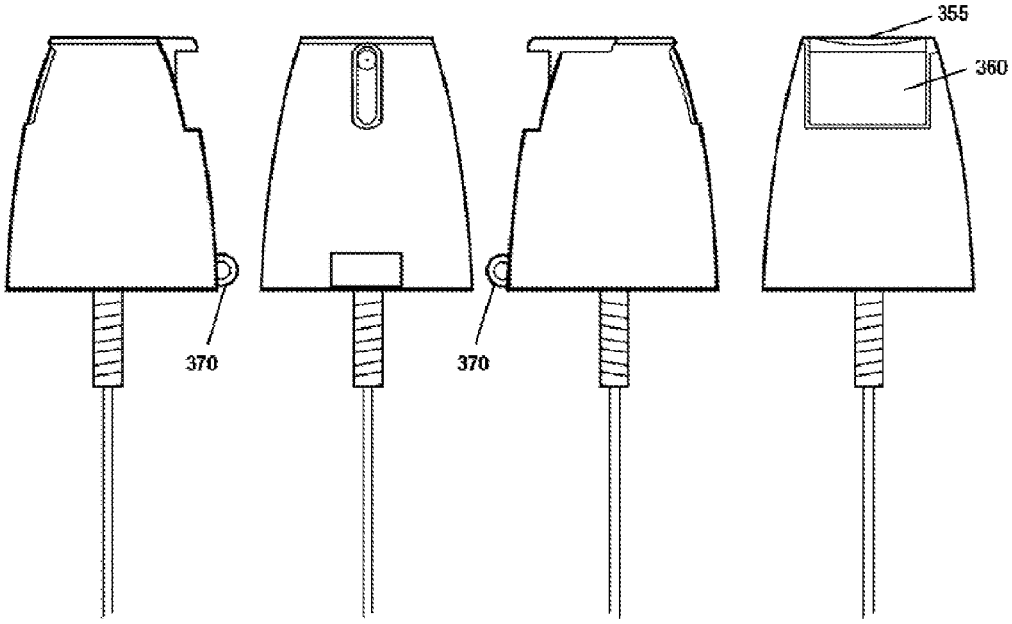
FIG. 37 is a front, rear and both side elevation view of an embodiment locking dispenser.
Figure 38:
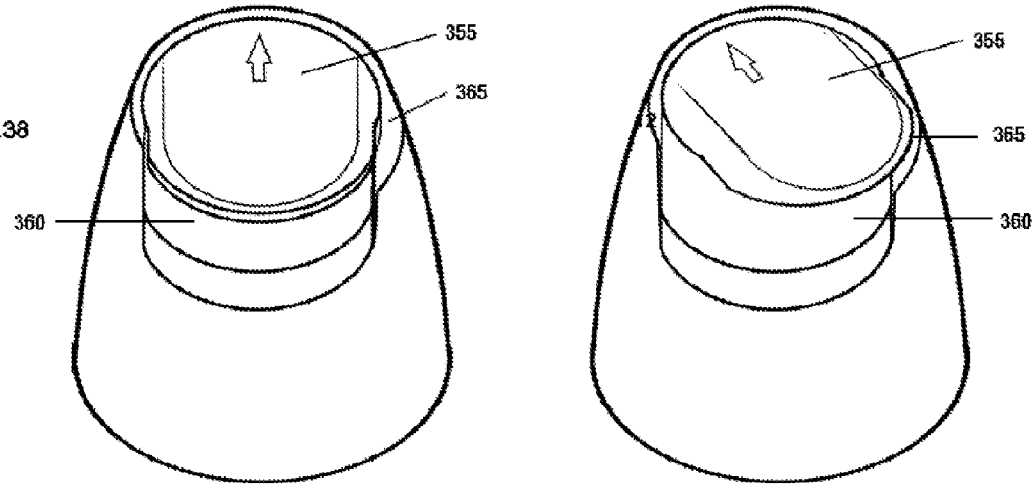
FIG. 38 is a perspective view of an embodiment locking dispenser.
Figure 39:
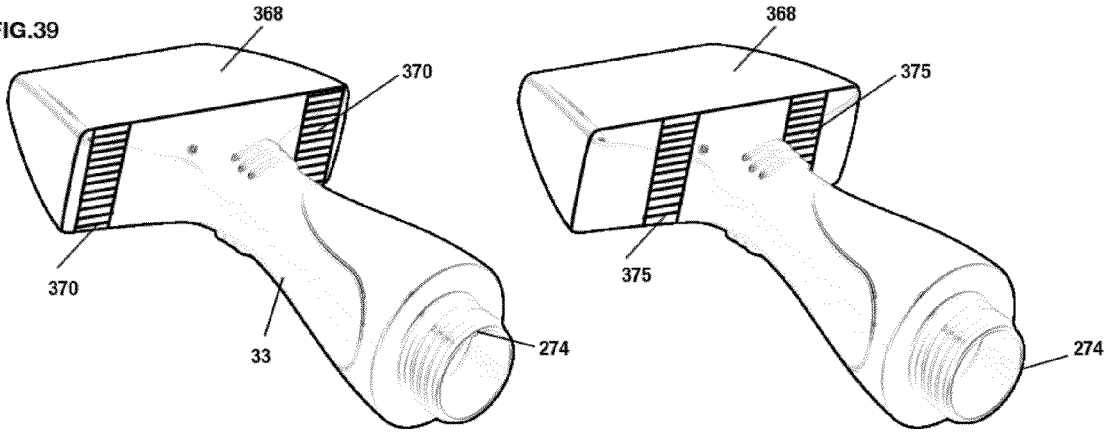
FIG. 39 is a perspective view of two embodiments of the present invention showing elasticized bands securing an embodiment cover.

Turning now to illustration FIGS. 37 and 38, product dispensers located at the terminal aspect of handle 33, such as pump dispenser 40 and spray dispenser 42 actuation surface 355 may be lockable to avoid inadvertent product distribution. In one embodiment, illustrated by FIG. 37 dispenser actuating surface 355, a portion of which may be rotated out of alignment of channel 360 to fit within a recess 365 to lock the dispenser and prevent actuation. Actuation surface 355 may be rotated back into alignment with channel 360 to permit downward movement of actuating surface 355 and product dispensing. FIG. 36 further illustrates the locking mechanism, and illustrates Turning to FIG. 39 in an alternative embodiment, uniform covering 368 may be a microfiber cover having a first surface and second surface, a first side surface, a second side surface, and an apex surface. Cover 368 is maintained in position through use of elasticized bands 370 which stretch to accommodate cover 50 to be placed over head and secured thereto. In one embodiment bands 370 extend to the lateral aspects of cover 50, in other embodiments, as illustrated by FIG. 39, elasticized bands 375 do not. One end of band 370 or 375 is attached to the surface of cover 50 resting over first surface 15, and the second end of band 370 or 375 is attached to that portion of the cover covering second surface 20.

Figure 40:
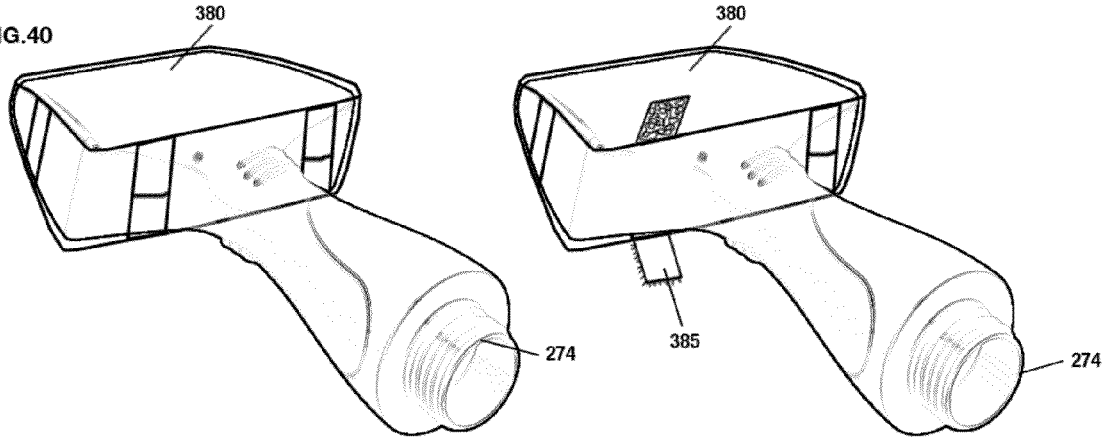
FIG. 40 is a perspective view of an embodiment showing an embodiment VELCRO attached cover with an embodiment scrubber bar and a top view of an embodiment cover.

FIG. 40 illustrates an embodiment connected by VELCRO tabs. In this embodiment cover 380 has tabs 385 disposed around the perimeter. Said tabs 385 have engageable surfaces that readily and reversibly couple with each other to secure cover 380 around head 10.

Although the present invention has been described with reference to the preferred embodiments, it should be understood that various modifications and variations can be easily made by those skilled in the art without departing from the scope and spirit of the invention. Accordingly, the foregoing disclosure should be interpreted as illustrative only and is not to be interpreted in a limiting sense. It is further intended that any other embodiments of the present invention that result from any changes in application or method of use or operation, method of manufacture, shape, size, or material which are not specified within the detailed written description or illustrations contained herein yet are considered apparent or obvious to one skilled in the art are within the scope of the present invention.

We claim:

1. A multisurface cleaning tool comprising:

a head portion having a top surface, bottom surface, a first side surface and second side surface and an apex and base, wherein said top and bottom surfaces form a long axis and said first and second side surfaces form a short axis, wherein said first and second side taper to form the apex, wherein the base is located opposite from the apex;

a hollow handle portion contiguous with the base of said head, wherein the hollow portion of said handle may constitute a reservoir capable of holding flowable material;

a pump actuated dispenser in communication with said reservoir permitting user actuated expression of flowable material; and at least one cover applied to at least a portion of said head.

2. The multisurface cleaning tool of claim 1, wherein said cover is a reversible, machine washable, microfiber pouch with an elasticized perimeter, wherein said pouch may be fitted over said head portion and secured around the base.

3. The multisurface cleaning tool of claim 2, wherein at least a portion of said cover is an integrally formed abrasive surface.

* * * * *